US010431159B2

(12) United States Patent
Fujimura

(10) Patent No.: US 10,431,159 B2
(45) Date of Patent: Oct. 1, 2019

(54) REGISTER CIRCUIT, DRIVER CIRCUIT, AND DISPLAY UNIT

(71) Applicant: JOLED Inc., Tokyo (JP)

(72) Inventor: Hiroshi Fujimura, Tokyo (JP)

(73) Assignee: JOLED INC., Tokyo (JP)

( * ) Notice: Subject to any disclaimer, the term of this patent is extended or adjusted under 35 U.S.C. 154(b) by 107 days.

(21) Appl. No.: 15/232,297

(22) Filed: Aug. 9, 2016

(65) Prior Publication Data

US 2017/0061879 A1 Mar. 2, 2017

(30) Foreign Application Priority Data

Aug. 25, 2015 (JP) ..... 2016-166181
Jun. 8, 2016 (JP) ..... 2016-114611

(51) Int. Cl.
*G09G 3/3266* (2016.01)

(52) U.S. Cl.
CPC ... *G09G 3/3266* (2013.01); *G09G 2310/0286* (2013.01)

(58) Field of Classification Search
CPC ..... G09G 3/3266; G09G 2310/0286
See application file for complete search history.

(56) References Cited

U.S. PATENT DOCUMENTS

2006/0001637 A1 1/2006 Pak et al.
2010/0026619 A1 2/2010 Umezaki
2010/0177082 A1 7/2010 Joo et al.
2011/0150169 A1 6/2011 Lin et al.
2013/0027378 A1* 1/2013 Lee ..... G09G 3/3677 345/212
2015/0029169 A1* 1/2015 Song ..... G09G 3/3225 345/212
2015/0228353 A1 8/2015 Qing et al.
2017/0025079 A1* 1/2017 Feng ..... G09G 3/3648

FOREIGN PATENT DOCUMENTS

CN 102194525 A 9/2011
JP 2006-024350 A 1/2006
KR 10-2010-0083370 A 7/2010

OTHER PUBLICATIONS

Japanese Office Action dated Oct. 9, 2018, for JP2016-114611.
Chinese Search Report dated Dec. 10, 2018 for CN201610697184.0.

* cited by examiner

*Primary Examiner* — Dennis P Joseph
(74) *Attorney, Agent, or Firm* — Michael Best & Friedrich LLP

(57) ABSTRACT

A register circuit includes an output circuit and an input circuit. The output circuit includes a first transistor and a second transistor. The first transistor is provided in a first electrically-conductive path between a first control terminal and an output terminal. The second transistor is provided in a second electrically-conductive path between a first power terminal and the output terminal. The input circuit includes a third transistor and a fourth transistor. The third transistor is provided in a third electrically-conductive path between an input terminal and a gate terminal of the first transistor. The fourth transistor is provided in a fourth electrically-conductive path between a second control terminal and a gate terminal of the third transistor and has a gate terminal that is coupled to the input terminal.

12 Claims, 13 Drawing Sheets

REGISTER CIRCUIT, DRIVER CIRCUIT, AND DISPLAY UNIT

CROSS REFERENCE TO RELATED APPLICATIONS

This application claims the benefit of Japanese Priority Patent Application JP 2015-166181 filed on Aug. 25, 2015, and Japanese Priority Patent Application JP 2016-114611 filed on Jun. 8, 2016, the entire contents of which are incorporated herein by reference.

BACKGROUND

The technology relates to a register circuit, a driver circuit, and a display unit.

A unit such as a flat-panel display unit and an X-Y address type solid-state image pickup unit may include a plurality of pixels that are arranged in a matrix. The plurality of pixels may be selected sequentially by a scanning circuit on a row-unit basis, for example. The respective pixels in a row selected by the scanning circuit may receive a signal, or a signal may be read out from the respective pixels in the row selected by the scanning circuit. The foregoing scanning circuit generally uses a shift register circuit as disclosed, for example, in Unexamined Japanese Patent Application Publication No. 2006-24350.

SUMMARY

The foregoing scanning circuit may involve a concern of a failure in operation due to leakage of a current.

It is desirable to provide a resistor circuit that makes it possible to reduce a failure in operation due to leakage of a current, and to provide a driver circuit and a display unit that each include the resistor circuit.

A resistor circuit according to one illustrative embodiment of the technology includes an output circuit and an input circuit. The output circuit includes a first transistor and a second transistor. The first transistor is provided in a first electrically-conductive path between a first control terminal and an output terminal. The second transistor is provided in a second electrically-conductive path between a first power terminal and the output terminal. The input circuit includes a third transistor and a fourth transistor. The third transistor is provided in a third electrically-conductive path between an input terminal and a gate terminal of the first transistor. The fourth transistor is provided in a fourth electrically-conductive path between a second control terminal and a gate terminal of the third transistor and has a gate terminal that is coupled to the input terminal. The register circuit according to the foregoing illustrative embodiment of the technology may further include a reset circuit. The reset circuit may include a fifth transistor. The fifth transistor may be provided in a fifth electrically-conductive path between a second power terminal and the gate terminal of the first transistor.

A driver circuit according to one illustrative embodiment of the technology includes a shift register circuit and a plurality of control signal lines. The shift register circuit includes a plurality of register circuits that are coupled in series, and includes a plurality of first register circuits. The plurality of control signal lines are coupled to the shift register circuit. The plurality of first register circuits each include a first output circuit and a first input circuit. The first output circuit includes a first transistor and a second transistor. The first transistor is provided in a first electrically-conductive path between a first control terminal and a first output terminal. The first control terminal is coupled to a first control signal line included in the plurality of control signal lines. The second transistor is provided in a second electrically-conductive path between a first power terminal and the first output terminal. The first input circuit includes a third transistor and a fourth transistor. The third transistor is provided in a third electrically-conductive path between a first input terminal and a gate terminal of the first transistor. The fourth transistor is provided in a fourth electrically-conductive path between a second control terminal and a gate terminal of the third transistor, and has a gate terminal that is coupled to the first input terminal. The second control terminal is coupled to a second control signal line included in the plurality of control signal lines. The plurality of first register circuits included in the plurality of register circuits in the driver circuit according to the foregoing illustrative embodiment of the technology may further include a first reset circuit. The first reset circuit may include a fifth transistor and a sixth electrically-conductive path. The fifth transistor may be provided in a fifth electrically-conductive path between a second power terminal and the gate terminal of the first transistor. The sixth electrically-conductive path may couple a third control terminal and a gate terminal of the fifth transistor to each other. The third control terminal may be coupled to a third control signal line included in the plurality of control signal lines.

A display unit according to one illustrative example of the technology includes a pixel array section and a drier circuit. The pixel array section includes a plurality of pixels that are arranged in a matrix. The driver circuit drives the respective plurality of pixels. The driver circuit includes a scanning circuit and a control circuit. The scanning circuit scans the respective plurality of pixels on a predetermined-unit basis. The control circuit controls the scanning circuit. The scanning circuit includes a shift register circuit and a plurality of control signal lines. The shift register circuit includes a plurality of register circuits that are coupled in series and includes a plurality of register circuits as a sub-group. The plurality of control signal lines are coupled to the shift register circuit. The plurality of register as the sub-group circuits each include an output circuit and an input circuit. The output circuit includes a first transistor and a second transistor. The first transistor is provided in a first electrically-conductive path between a first control terminal and a first output terminal. The first control terminal is coupled to a first control signal line included in the plurality of control signal lines. The second transistor is provided in a second electrically-conductive path between a first power terminal and the first output terminal. The input circuit includes a third transistor and a fourth transistor. The third transistor is provided in a third electrically-conductive path between a first input terminal and a gate terminal of the first transistor. The fourth transistor is provided in a fourth electrically-conductive path between a second control terminal and a gate terminal of the third transistor, and has a gate terminal that is coupled to the first input terminal. The second control terminal is coupled to a second control signal line included in the plurality of control signal lines.

A driver circuit according to another illustrative embodiment of the technology includes a shift register circuit and a control circuit. The shift register circuit includes a plurality of register circuits that are coupled in series. The control circuit supplies a clock signal to the shift register circuit. The plurality of register circuits, except for a first register circuit, each include an input transistor, an output transistor, a capacitor, and an input stabilizer circuit. The input transistor has a drain terminal that receives, as an input signal, an output signal from one preceding register circuit included in the plurality of register circuits. The output transistor controls an output signal outputted from a source terminal of the output transistor, on a basis of one of a source voltage of the input transistor and a voltage correlated with the source voltage of the input transistor. The capacitor holds a gate-source voltage of the output transistor. The input stabilizer circuit stabilizes a gate voltage of the input transistor when the input transistor is turned off, on a basis of the clock signal supplied from the control circuit.

A display unit according to one illustrative embodiment of the technology includes a pixel array section and a driver circuit. The pixel array section includes a plurality of pixels that are arranged in a matrix. The driver circuit drives the respective plurality of pixels. The driver circuit includes a scanning circuit and a control circuit. The scanning circuit scans the respective plurality of pixels on a predetermined-unit basis. The control circuit controls the scanning circuit. The scanning circuit includes a shift register circuit and a control circuit. The shift register circuit includes a plurality of register circuits that are coupled in series. The control circuit supplies a clock signal to the shift register circuit. The plurality of register circuits, except for a first register circuit, each include an input transistor, an output transistor, a capacitor, and an input stabilizer circuit. The input transistor has a drain terminal that receives, as an input signal, an output signal from one preceding register circuit included in the plurality of register circuits. The output transistor controls an output signal outputted from a source terminal of the output transistor, on a basis of one of a source voltage of the input transistor and a voltage correlated with the source voltage of the input transistor. The capacitor holds a gate-source voltage of the output transistor. The input stabilizer circuit stabilizes a gate voltage of the input transistor when the input transistor is turned off, on a basis of the clock signal supplied from the control circuit.

DETAILED DESCRIPTION

Some example embodiments of the technology are described below in detail with reference to the drawings. The description is given in the following order.

1. First Example Embodiment (Display Unit)
2. Modifications (Display Units)
3. Second Example Embodiment (Display Unit)
4. Application Example (Electronic Apparatus)

1. First Example Embodiment

Configuration

Figure 1:
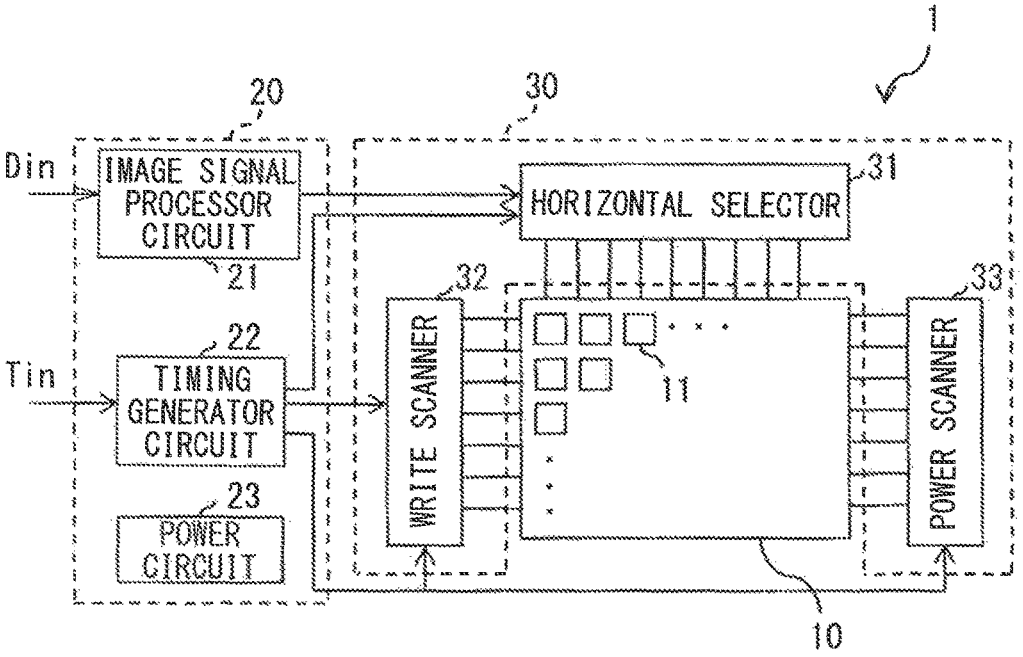
FIG. 1 illustrates an outline configuration of a display unit according to a first example embodiment of the technology.

FIG. 1 illustrates an outline configuration of a display unit 1 according to a first example embodiment of the technology. The display unit 1 may include a pixel array section 10, a controller 20, and a driver 30. The controller 20 and the driver 30 may correspond to a "driver circuit" in one specific but non-limiting embodiment of the technology. The pixel array section 10 includes a plurality of pixels 11 that are arranged in a matrix. The controller 20 and the driver 30 may drive the respective pixels 11 on the basis of an image signal Din and a synchronization signal Tin that are supplied from outside.

(Pixel Array Section 10)

Figure 2:
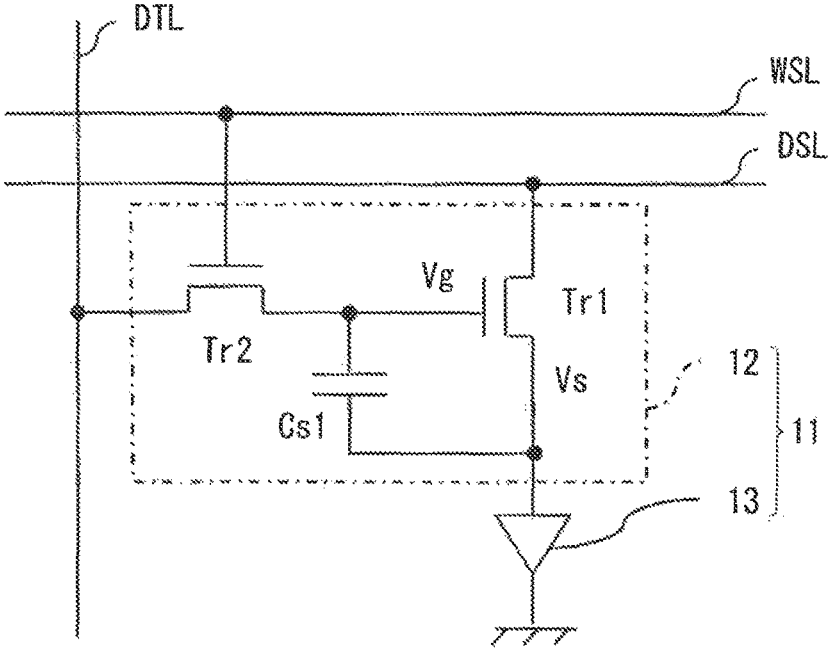
FIG. 2 illustrates an example of a circuit configuration of each pixel.

FIG. 2 illustrates an example of a circuit configuration of each of the pixels 11 included in the pixel array section 10. The pixel array section 10 may display an image based on the image signal Din and the synchronization signal Tin that are supplied from the outside, in response to active-matrix driving performed on the respective pixels 11 by the controller 20 and the driver 30. The pixel array section 10 may include a plurality of scanning lines WSL, a plurality of power lines DSL, a plurality of signal lines DTL, and the plurality of pixels 11. The plurality of scanning lines WSL and the plurality of power lines DSL may extend in a row direction. The plurality of signal lines DTL may extend in a column direction. The plurality of pixels 11 are each provided at corresponding one of points at which the respective scanning lines WSL intersect with the corresponding signal lines DTL.

The scanning lines WSL may each be used to select each of the pixels 11. The scanning lines WSL may each supply each of the pixels 11 with a selection pulse to thereby select each of the pixels 11 on a predetermined-unit basis (for example, on a pixel-row basis). The signal lines DTL may each be used to supply each of the pixels 11 with a signal voltage Vsig based on the image signal Din. Specifically, the signal lines DTL may each supply each of the pixels 11 with a data pulse including the signal voltage Vsig. The power lines DSL may each supply each of the pixels 11 with electricity.

Each of the pixels 11 may include a pixel circuit 12 and an organic EL element 13, for example. The organic EL element 13 may have a configuration in which an anode, an organic layer, and a cathode are stacked in order. The organic EL element 13 may have an element capacitance. The pixel circuit 12 may control a light-emission state and a non-light-emission state of the organic EL element 13. The pixel circuit 12 may hold a voltage that is written into each of the pixels 11 through write scanning which will be described later. The pixel circuit 12 may include a driving transistor Tr1, a writing transistor Tr2, and a capacitor Cs1, for example.

The writing transistor Tr2 may control supply of the signal voltage Vsig based on the image signal Din, to a gate terminal of the driving transistor Tr1. More specifically, the writing transistor Tr2 may sample a voltage of the signal line DTL and write the sampled voltage into the gate terminal of the driving transistor Tr1. The driving transistor Tr1 may be coupled to the organic EL element 13 in series. The driving transistor Tr1 may drive the organic EL element 13. The driving transistor Tr1 may control a current that flows through the organic EL element 13 on the basis of the magnitude of the voltage sampled by the writing transistor Tr2. The capacitor Cs1 may hold a predetermined voltage between the gate terminal and a source terminal of the driving transistor Tr1. The capacitor Cs1 may allow a gate-source voltage Vgs of the driving transistor Tr1 to be constant during a standby period which will be described later. It is to be noted that the pixel circuit 12 may have a circuit configuration that includes components such as various capacitors and various transistors in addition to the foregoing 2Tr1C circuit configuration, or may have a circuit configuration different from the foregoing 2Tr1C circuit configuration.

The driving transistor Tr1 and the writing transistor Tr2 may each be an n-channel metal-oxide-semiconductor (MOS) thin film transistor (TFT), for example. It is to be noted that, however, the driving transistor Tr1 and the writing transistor Tr2 may each be a p-channel MOS TFT. A description is given below referring to an example case where the driving transistor Tr1 and the writing transistor Tr2 are each an enhancement-mode transistor. However, the driving transistor Tr1 and the writing transistor Tr2 may each be a depletion-mode transistor.

The signal lines DTL may each be coupled to an unillustrated output terminal of a horizontal selector 31 which will be described later, and also coupled to one of a source terminal and a drain terminal of the writing transistor Tr2. The scanning lines WSL may each be coupled to an unillustrated output terminal of a write scanner 32 which will be described later, and also coupled to a gate terminal of the writing transistor Tr2. The power lines DSL may each be coupled to an unillustrated output terminal of an electric power supply, and also coupled to one of the source terminal and a drain terminal of the driving transistor Tr1. The electric power supply may output a fixed voltage.

The gate terminal of the writing transistor Tr2 may be coupled to corresponding one of the scanning lines WSL. One of the source terminal and the drain terminal of the writing transistor Tr2 may be coupled to corresponding one of the signal lines DTL. The other of the source terminal and the drain terminal of the writing transistor Tr2, which is not coupled to any of the signal lines DTL, may be coupled to the gate terminal of the driving transistor Tr1. One of the source terminal and the drain terminal of the driving transistor Tr1 may be coupled to corresponding one of the power lines DSL. The other of the source terminal and the drain terminal of the driving transistor Tr1, which is not coupled to any of the power lines DSL, may be coupled to the anode of the organic EL element 13. One terminal of the capacitor Cs1 may be coupled to the gate terminal of the driving transistor Tr1. The other terminal of the capacitor C1 may be coupled to one, on the organic EL element 13 side, of the source terminal and the drain terminal of the driving transistor Tr1.

The driver 30 may include the horizontal selector 31, the write scanner 32, and a power scanner 33, for example. The write scanner 32 may correspond to a "driver circuit" and a "scanning circuit" in one specific but non-limiting embodiment of the technology.

The horizontal selector 31 may supply each of the signal lines DTL with the analog signal voltage Vsig in response to reception of a control signal (in synchronization with the reception of the control signal), for example. The analog signal voltage Vsig may be supplied to the horizontal selector 31 from the image signal processor circuit 21. The horizontal selector 31 may be allowed to output two kinds of voltages (Vofs and Vsig), for example. More specifically, the horizontal selector 31 may supply the pixel 11 selected by the write scanner 32, with the two kinds of voltages (Vofs and Vsig) via the signal line DTL. The signal voltage Vsig may have a voltage value based on the image signal Din. The fixed voltage Vofs may be a constant voltage irrelevant to the image signal Din. The minimum voltage of the signal voltage Vsig may have a voltage value smaller than a voltage value of the fixed voltage Vofs. The maximum voltage of the signal voltage Vsig may have a voltage value greater than the voltage value of the fixed voltage Vofs. The horizontal selector 31 may supply each of the signal lines DTL with a data pulse including the signal voltage Vsig for each horizontal period. The horizontal selector 31 may supply each of the signal lines DTL with a binary pulse as a data pulse. The binary pulse may include the signal voltage Vsig and the fixed voltage Vofs.

The write scanner 32 may scan the respective pixels 11 on a predetermined-unit basis. More specifically, the write scanner 32 may sequentially supply selection pulses to the respective scanning lines WSL in one frame period. The write scanner 32 may select the respective scanning lines WSL in a predetermined sequence in response to reception of the control signal (in synchronization with the reception of the control signal), thereby allowing for execution of operations such as threshold correction preparation, threshold correction, writing of the signal voltage Vsig, electron mobility correction, and light emission, in preferable order, for example. The threshold correction preparation may refer to initialization of the gate voltage of the driving transistor Tr1 (specifically, may refer to setting the gate voltage of the driving transistor Tr1 to the fixed voltage Vofs). The threshold correction may refer to a correction operation to cause the gate-source voltage Vgs of the driving transistor Tr1 to be varied toward the threshold voltage of the driving transistor Tr1. The writing (signal writing) of the signal voltage Vsig may refer to an operation of writing the signal voltage Vsig into the gate terminal of the driving transistor Tr1 via the writing transistor Tr2. The electron mobility correction may refer to an operation of correcting the voltage that is held between the gate terminal and the source terminal of the driving transistor Tr1 (the gate-source voltage Vgs) on the basis of the magnitude of electron mobility of the driving transistor Tr1. The signal writing and the electron mobility correction may be performed at timings different from each other in some cases. However, the present example embodiment may have a configuration in which the signal writing and the electron mobility correction are performed at the same timing (or performed successively without any time lag) by causing the write scanner 32 to supply one selection pulse to each of the scanning lines WSL.

The write scanner 32 may output two kinds of voltages (Von and Voff), for example. More specifically, the write scanner 32 may supply the two kinds of voltages (Von and Voff) to each of the pixels 11 to be driven via the scanning line WSL, thereby performing ON-OFF control on the writing transistor Tr2. The ON voltage Von may have a value that is equal to or greater than a value of an ON voltage of the writing transistor Tr2. The ON voltage Von may have a peak value of the selection pulse outputted from the write scanner 32 in a period such as a threshold correction preparation period, a threshold correction period, and a signal writing and electron mobility correction period which will be described later. The OFF voltage Voff may have a value that is smaller than the value of the ON voltage of the writing transistor Tr2 and is smaller than the value of the ON voltage Von.

Figure 3:
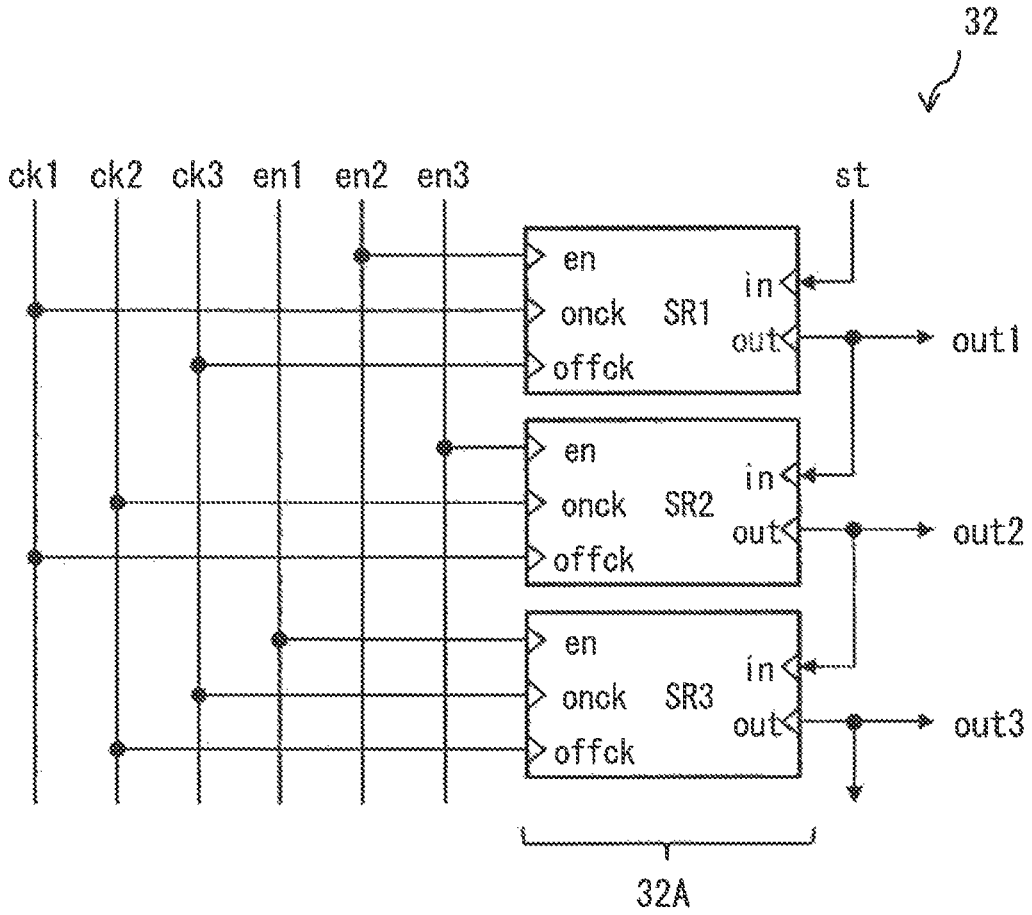
FIG. 3 illustrates an example of a circuit configuration of a write scanner.

Next, a circuit configuration of the write scanner 32 is described. FIG. 3 illustrates an example of the circuit configuration of the write scanner 32. The write scanner 32 may include a shift register circuit 32A and a plurality of control signal lines. The shift register circuit 32A includes a plurality of register circuits SR (SR1, SR2, SR3, . . . , SRn) that are coupled in series. The plurality of control signal lines are each coupled to the shift register circuit 32A. Each of the register circuits SR may correspond to a "register circuit" in one specific but non-limiting embodiment of the technology. The shift register circuit 32A may correspond to a "shift register circuit" in one specific but non-limiting embodiment of the technology. The write scanner 32 may include a circuit such as a logic circuit and a buffer circuit that is coupled to respective output terminals (out1, out2, out3, outn) of the shift register circuit 32A.

The plurality of control signal lines may include three cut-off control lines ck1, ck2, and ck3, and three transfer control lines en1, en2, and en3. The three cut-off control lines ck1, ck2, and ck3, and the three transfer control lines en1, en2, and en3 may correspond to "plurality of control signal lines" in one specific but non-limiting embodiment of the technology. The cut-off control line ck1 may correspond to a "second control signal line" in one specific but non-limiting embodiment of the technology. The cut-off control line ck2 may correspond to a "fifth control signal line" in one specific but non-limiting embodiment of the technology. The cut-off control line ck3 may correspond to a "third control signal line" in one specific but non-limiting embodiment of the technology. The transfer control line en1 may correspond to a "sixth control signal line" in one specific but non-limiting embodiment of the technology. The transfer control line en2 may correspond to a "first control signal line" in one specific but non-limiting embodiment of the technology. The transfer control line en3 may correspond to a "fourth control signal line" in one specific but non-limiting embodiment of the technology.

The respective register circuits SR (SRL SR2, SR3, SRn) may have the same circuit configuration. The register circuits SR (SRL SR2, SR3, SRn) may be grouped into three kinds of groups depending on how to be coupled to the control signal lines. A plurality of register circuits SRa (a=1+3 m, where m is an integer equal to or greater than 0 (zero)) included in the register circuits SR may each be coupled to the cut-off control line ck1, the cut-off control line ck3, and the transfer control line en2. The register circuits SRa may correspond to "first register circuits" in one specific but non-limiting embodiment of the technology. Each of the register circuits SRa may have an enable terminal en, a clock terminal onck, a clock terminal offck that are coupled to the transfer control line en2, the cut-off control line ck1, and the cut-off control line ck3, respectively. The enable terminal en, the clock terminal onck, and the clock terminal offck will be described later.

The plurality of register circuits SR (SRL SR2, SR3, SRn) may include a plurality of register circuits SRb (b=2+3 m, where m is an integer equal to or greater than 0 (zero)) and a plurality of register circuits SRc (c=3+3 m, where m is an integer equal to or greater than 0 (zero)) in addition to the plurality of register circuits SRa. The register circuits SRb may correspond to "second register circuits" in one specific but non-limiting embodiment of the technology. The register circuits SRc may correspond to "third register circuits" in one specific but non-limiting embodiment of the technology. The plurality of register circuits SRb may each be coupled to the cut-off control line ck1, the cut-off control line ck2, and the transfer control line en3. Each of the register circuits SRb may have an enable terminal en, a clock terminal onck, and a clock terminal offck that are coupled to the transfer control line en3, the cut-off control line ck2, and the cut-off control line ck1, respectively. The enable terminal en, the clock terminal onck, and the clock terminal offck will be described later. The plurality of register circuits SRc may each be coupled to the cut-off control line ck2, the cut-off control line ck3, and the transfer control line en1. Each of the register circuits SRc may have an enable terminal en, a clock terminal onck, and a clock terminal offck that are coupled to the transfer control line en1, the cut-off control control line ck3, and the cut-off control line ck2, respectively. The enable terminal en, the clock terminal onck, and the clock terminal offck will be described later.

Figure 4:
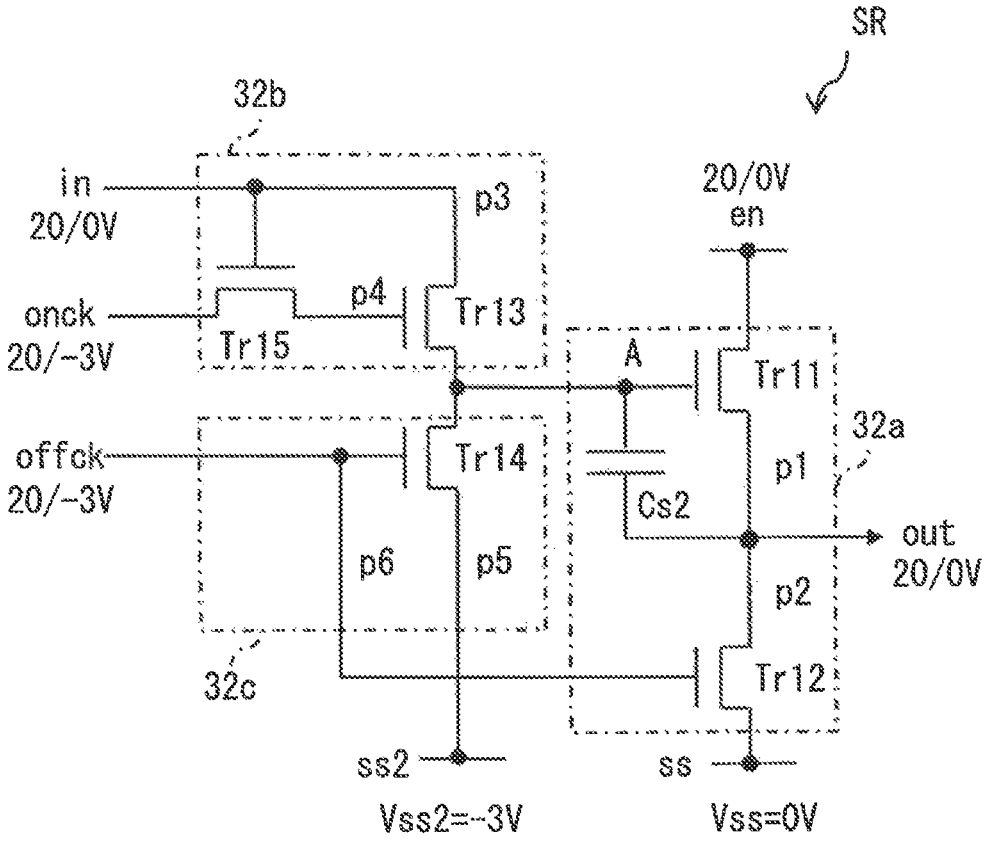
FIG. 4 illustrates an example of a circuit configuration of a register circuit.

FIG. 4 illustrates an example of the circuit configuration of each of the register circuits SR. Each of the register circuits SR may include an output circuit 32*a*, an input circuit 32*b*, and a reset circuit 32*c*, for example. The output circuit 32*a* may correspond to an "output circuit" in one specific but non-limiting embodiment of the technology. The input circuit 32*b* may correspond to an "input circuit" in one specific but non-limiting embodiment of the technology. The reset circuit 32*c* may correspond to a "reset circuit" in one specific but non-limiting embodiment of the technology. Further, the output circuit 32*a* included in the register circuit SRa may correspond to a "first output circuit" in one specific but non-limiting embodiment of the technology. The output circuit 32*a* included in the register circuit SRb may correspond to a "second output circuit" in one specific but non-limiting embodiment of the technology. The output circuit 32*a* included in the register circuit SRc may correspond to a "third output circuit" in one specific but non-limiting embodiment of the technology. The input circuit 32*b* included in the register circuit SRa may correspond to a "first input circuit" in one specific but non-limiting embodiment of the technology. The input circuit 32*b* included in the register circuit SRb may correspond to a "second input circuit" in one specific but non-limiting embodiment of the technology. The input circuit 32*b* included in the register circuit SRc may correspond to a "third input circuit" in one specific but non-limiting embodiment of the technology. The reset circuit 32*c* included in the register circuit SRa may correspond to a "first reset circuit" in one specific but non-limiting embodiment of the technology. The reset circuit 32*c* included in the register circuit SRb may correspond to a "second reset circuit" in one specific but non-limiting embodiment of the technology. The reset circuit 32*c* included in the register circuit SRc may correspond to a "third reset circuit" in one specific but non-limiting embodiment of the technology.

The output circuit 32*a* may include a transistor Tr11 and a transistor Tr12. The transistor Tr11 may be provided in an electrically-conductive path p1 between the enable terminal en and the output terminal out. The transistor Tr12 may be provided in an electrically-conductive path p2 between a power terminal ss and the output terminal out. The phrase "electrically-conductive path" encompasses the presence of a path of an electric circuit in addition to a state that involves simple coupling by means of a wiring pattern. The output circuit 32*a* may further include a capacitor Cs2 that holds a potential difference between a gate terminal of the transistor Tr11 and the output terminal out. The power terminal ss may be a terminal that receives a fixed voltage Vss for setting a voltage of the output terminal out to a Lo level (a low level).

The enable terminal en may correspond to a "first control terminal" in one specific but non-limiting embodiment of the technology. The output terminal out may correspond to an "output terminal" in one specific but non-limiting embodiment of the technology. The electrically-conductive path p1 may correspond to a "first electrically-conductive path" in one specific but non-limiting embodiment of the technology. The transistor Tr11 may correspond to a "first transistor" in one specific but non-limiting embodiment of the technology. The power terminal ss may correspond to a "first power terminal" in one specific but non-limiting embodiment of the technology. The electrically-conductive path p2 may correspond to a "second electrically-conductive path" in one specific but non-limiting embodiment of the technology. The transistor Tr12 may correspond to a "second transistor" in one specific but non-limiting embodiment of the technology. The capacitor Cs2 may correspond to a "capacitor" in one specific but non-limiting embodiment of the technology.

The input circuit 32*b* may supply the input terminal of the output circuit 32*a* (a gate terminal A of the transistor Tr11) with an input signal that is supplied to the input terminal in. The input circuit 32*b* may include a transistor Tr13 and a transistor Tr15. The transistor Tr13 may be provided in an electrically-conductive path p3 between the input terminal in and the gate terminal A of the transistor Tr11. The transistor Tr15 may be provided in an electrically-conductive path p4 between the clock terminal onck and a gate terminal of the transistor Tr13, and have a gate terminal that is coupled to the input terminal in.

The input terminal in may correspond to an "input terminal" in one specific but non-limiting embodiment of the technology. The electrically-conductive path p3 may correspond to a "third electrically-conductive path" in one specific but non-limiting embodiment of the technology. The transistor Tr13 may correspond to a "third transistor" in one specific but non-limiting embodiment of the technology. The clock terminal onck may correspond to a "second control terminal" in one specific but non-limiting embodiment of the technology. The electrically-conductive path p4 may correspond to a "fourth electrically-conductive path" in one specific but non-limiting embodiment of the technology. The transistor Tr15 may correspond to a "fourth transistor" in one specific but non-limiting embodiment of the technology.

The reset circuit 32*c* may reset a voltage of the input terminal of the output circuit 32*a* (the gate terminal A of the transistor Tr11) to a predetermined value. The reset circuit 32*c* may have a transistor Tr14 and an electrically-conductive path p6. The transistor Tr14 may be provided in an electrically-conductive path p5 between a power terminal ss2 and the gate terminal A of the transistor Tr11. The electrically-conductive path p6 may couple the clock terminal offck, a gate terminal of the transistor Tr14, and a gate terminal of the transistor Tr12 to one another. The power terminal ss2 may be a terminal that receives a fixed voltage Vss2 for setting a voltage of the gate terminal A of the transistor Tr11 to a Lo level. The fixed voltage Vss2 may be a threshold voltage of the transistor Tr14, for example. The threshold voltage of the transistor Tr14 may be −3 V, for example.

The power terminal ss2 may correspond to a "second power terminal" in one specific but non-limiting embodiment of the technology. The electrically-conductive path p5 may correspond to a "fifth electrically-conductive path" in one specific but non-limiting embodiment of the technology. The transistor Tr14 may correspond to a "fifth transistor" in one specific but non-limiting embodiment of the technology. The clock terminal offck may correspond to a "third control terminal" in one specific but non-limiting embodiment of the technology. The electrically-conductive path p6 may correspond to a "sixth electrically-conductive path" in one specific but non-limiting embodiment of the technology.

The power scanner 33 may sequentially select the plurality of power lines DSL on a predetermined-unit basis, in response to (in synchronization with) reception of the control signal, for example. The power scanner 33 may output two kinds of voltages (Vcc and Vss), for example. More specifically, the power scanner 33 may supply the two kinds of voltages (Vcc and Vss) to each of the pixels 11 selected by the write scanner 32, via the corresponding power line DSL. The fixed voltage Vss may have a voltage value that is smaller than a voltage value of the sum (Vel+Vcath) of a threshold voltage Vel of the organic EL element 13 and a cathode voltage Vcath of the organic EL element 13. The fixed voltage Vcc may have a voltage value that is larger than the voltage value of the sum (Vel+Vcath) of the threshold voltage Vel of the organic EL element 13 and the cathode voltage Vcath of the organic EL element 13.

In the present example embodiment, each of the transistors Tr11, Tr12, Tr13, Tr14, and Tr15 may be an n-channel MOS TFT, for example. It is to be noted that, however, each of the transistors Tr11, Tr12, Tr13, Tr14, and Tr15 may be a p-channel MOS TFT. A description below is given referring to an example case where each of the transistors Tr11 Tr12, Tr13, Tr14, and Tr15 may be a depletion-mode transistor. However, each of the transistors Tr11, Tr12, Tr13, Tr14, and Tr15 may be an enhancement-mode transistor.

(Controller 20)

Next, the controller 20 is described. The controller 20 may include an image signal processor circuit 21, a timing generator circuit 22, and a power circuit 23, for example. The timing generator circuit 22 may correspond to a "control circuit" in one specific but non-limiting embodiment of the technology. The image signal processor circuit 21 may perform predetermined correction on the digital image signal Din supplied from the outside, thereby generating the signal voltage Vsig on the basis of an image signal obtained through the predetermined correction, for example. The image signal processor circuit 21 may supply the generated signal voltage Vsig to the horizontal selector 31, for example. Non-limiting examples of the predetermined correction may include gamma correction and overdrive correction. The timing generator circuit 22 may so perform control that the respective circuits in the driver 30 operate in accordance with one another. The timing generator circuit 22 may supply a control signal to each of the circuits in the driver 30 in response to (in synchronization with) the synchronization signal Tin supplied from the outside, for example. The power circuit 23 may generate various fixed voltages for various circuits such as the horizontal selector 31, the write scanner 32, the power scanner 33, the image signal processor circuit 21, and the timing generator circuit 22, and supply the generated various voltages to the foregoing various circuits. The power circuit 23 may generate voltages such as the voltage Vss, the voltage Vss2, and the voltage Vcc, and supply the generated voltages to the foregoing various circuits. To give an example, the voltage Vss, the voltage Vss2, and the voltage Vcc may be respectively 0 (zero) V, −3 V, and 20V.

Figure 5:
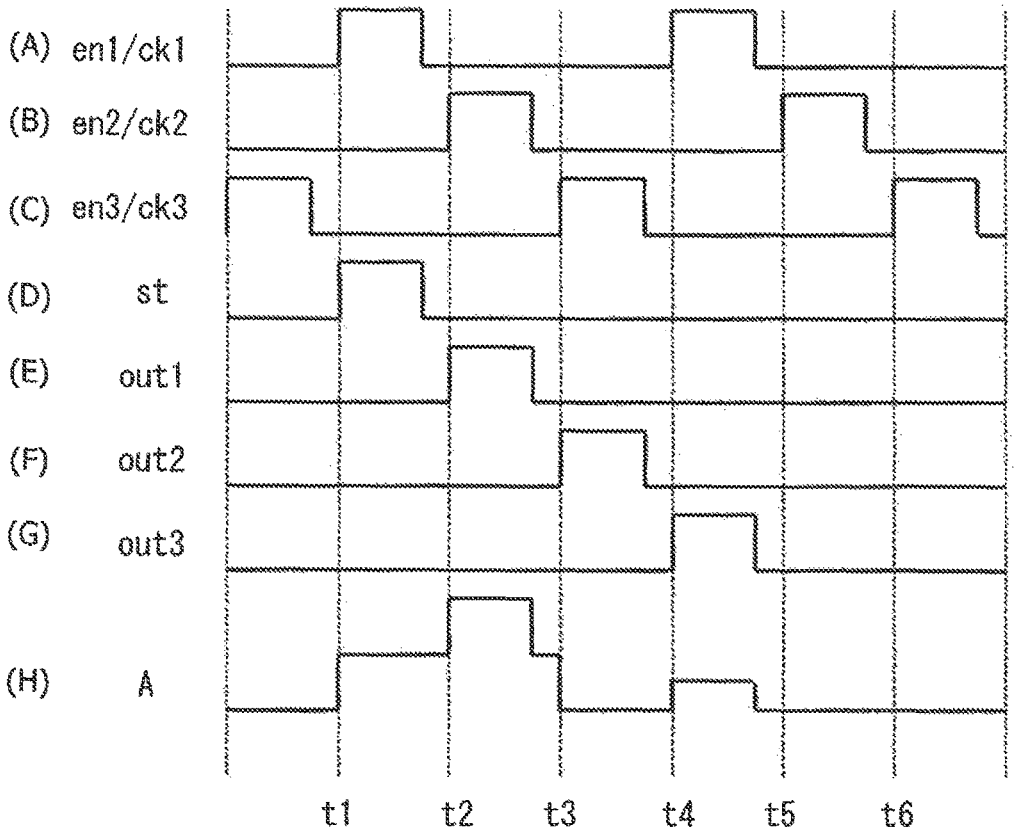
FIG. 5 illustrates an example of input and output waveforms of the shift register circuit.

Next, input and output waveforms of the write scanner 32 are described. FIG. 5 illustrates an example of the input and output waveforms of the write scanner 32. Part (A) of FIG. 5 illustrates an example of a control signal that is supplied to each of the transfer control line en1 and the cut-off control line ck1. Part (B) of FIG. 5 illustrates an example of a control signal that is supplied to each of the transfer control line en2 and the cut-off control line ck2. Part (C) of FIG. 5 illustrates an example of a control signal that is supplied to each of the transfer control line en3 and the cut-off control line ck3. Part (D) of FIG. 5 illustrates an example of an input signal st that is supplied to an input terminal in of the register circuit SR1 that is the first register circuit in the shift register circuit 32A. Part (E) of FIG. 5 illustrates an example of a signal that is outputted from an output terminal out1 of the register circuit SR1. Part (F) of FIG. 5 illustrates an example of a signal that is outputted from an output terminal out 2 of the register circuit SR2 that is the second register circuit in the shift register circuit 32A. Part (G) of FIG. 5 illustrates an example of a signal that is outputted from an output terminal out3 of the register circuit SR3 that is the third register circuit in the shift register circuit 32A. Part (H) of FIG. 5 illustrates an example of a signal that is supplied to the gate terminal A of the transistor Tr11 of the register circuit SR1.

The timing generator circuit 22 may supply three clock signals included in a three-phase clock signal (control signal) to the respective cut-off control lines ck1 to ck3, and supply three enable signals included in a three-phase enable signal (control signal) to the respective transfer control lines en1 to en3. The three-phase clock signal includes the signals that have different phases from one another and have the same waveform but are active in different periods from one another. The three-phase enable signal includes the signals that have different phases from one another and have the same waveform but are active in different periods from one another. The timing generator circuit 22 may synchronize the phase of the clock signal to be supplied to the cut-off control line ck1 with the phase of the enable signal to be supplied to the transfer control line en1, for example. The timing generator circuit 22 may synchronize the phase of the clock signal to be supplied to the cut-off control line ck2 with the phase of the enable signal to be supplied to the transfer control line en2, for example. The timing generator circuit 22 may synchronize the phase of the clock signal to be supplied to the cut-off control line ck3 with the phase of the enable signal to be supplied to the transfer control line en3, for example.

It is to be noted that the timing generator circuit 22 may shift the phase of the enable signal to be supplied to the transfer control line en1 from the phase of the clock signal to be supplied to the cut-off control line ck1 in a range that allows the signals included in the three-phase enable signal to be active in different periods from one another. The timing generator circuit 22 may shift timings of rising and falling of a pulse, of the enable signal to be supplied to the transfer control line en1, in a period from time t1 to time t2, from timings of rising and falling of a pulse, of the clock signal to be supplied to the cut-off control line ck1, in the period from the time t1 to the time t2. The timing generator circuit 22 may shift the phase of the enable signal to be supplied to the transfer control line en2 from the phase of the clock signal to be supplied to the cut-off control line ck2 in a range that allows the signals included in the three-phase enable signal to be active in different periods from one another. The timing generator circuit 22 may shift timings of rising and falling of a pulse, of the enable signal to be supplied to the transfer control line en2, in a period from the time t2 to time t3, from timings of rising and falling of a pulse, of the clock signal to be supplied to the cut-off control line ck2, in the period from the time t2 to the time t3. The timing generator circuit 22 may shift the phase of the enable signal to be supplied to the transfer control line en3 from the phase of the clock signal to be supplied to the cut-off control line ck3 in a range that allows the signals included in the three-phase enable signal to be active in different periods from one another. The timing generator circuit 22 may shift timings of rising and falling of a pulse, of the enable signal to be supplied to the transfer control line en3, in a period from the time t3 to time t4, from timings of rising and falling of a pulse, of the clock signal to be supplied to the cut-off control line ck3, in the period from the time t3 to the time t4.

The timing generator circuit 22 may set a Hi level (a high level) of the clock signal to a voltage that is higher than a threshold voltage Vth of each of the transistors Tr11 to Tr15. For example, the timing generator circuit 22 may set the Hi level of the clock signal to 20 V. The timing generator circuit 22 may set a Lo level (a low level) of the clock signal to a voltage that is equal to or lower than the threshold voltage Vth of each of the transistors Tr11 to Tr15. For example, the timing generator circuit 22 may set the Lo level of the clock signal to the threshold voltage Vth of each of the transistors Tr11 to Tr15, which may be −3 V. The timing generator circuit 22 may set a Hi level of the enable signal to a voltage that is higher than 0 (zero) V. For example, the timing generator circuit 22 may set the Hi level of the enable signal to 20 V. The timing generator circuit 22 may set a Lo level of the enable signal to 0 (zero) V, for example. The timing generator circuit 22 may so synchronize a phase of the input signal st to be supplied to the input terminal in of the register circuit SR1 with a phase of the clock signal to be supplied to the cut-off control line ck1, that the foregoing input signal st and the foregoing clock signal make a transition to a Hi level at the same time. It is to be noted that the timing generator circuit 22 may shift the phase of the input signal st from the phase of the clock signal to be supplied to the cut-off control line ck1 in a range that allows for presence of a period in which both the input signal st and the clock signal to be supplied to the cut-off control line ck1 are at the Hi level.

The shift register circuit 32A may have a configuration in which the input terminal in of the register circuit SR1 receives the input signal st and the cut-off control line ck1 receives the clock signal, causing the gate terminal A of the register circuit SR1 to be set at the Hi level, at the time t1. The transfer control line en2 may receive the enable signal at the time t2, bootstrapping the voltage of the gate terminal A of the register circuit SR1 to turn on the transistor Tr11. The time t2 is a time that is 1 H after the time t1. As a result, the voltage of the transfer control line en2 may be outputted from the output terminal out1 of the register circuit SR1. The voltage of the transfer control line en2 may be 20 V, for example. The cut-off control line ck3 may receive the clock signal at the time t3, resetting the voltage of the gate terminal A of the register circuit SR1 to the Lo level. The Lo level of the voltage of the gate terminal A of the register circuit SR1 may be −3 V, for example. The time t3 is a time that is 1 H after the time t2.

The cut-off control line ck1 may receive the enable signal at the time t4, increasing the gate voltage of the transistor Tr13 from the Lo level to a voltage corresponding to a difference between the voltage Vss and the voltage Vth (Vss−Vth). The Lo level of the gate voltage of the transistor Tr13 may be −3 V, for example. The voltage Vss−Vth may be a difference between 0 (zero) V and the voltage Vth. The foregoing voltage Vth may be the threshold voltage of the transistor Tr15. For example, when the gate voltage of the transistor Tr13 is increased to 3 V, the transistor Tr13 may be turned on, causing the voltage of the gate terminal A to be increased toward 0 (zero) V. When the transistor Tr14 is the depletion-mode transistor, a through current flows from the input terminal in to the power terminal ss2. The voltage of the gate terminal A at this time depends on a resistance ratio between the transistor Tr13 and the transistor Tr14. Hence, the resistance ratio between the transistor Tr13 and the transistor Tr14 may have a value that causes difficulty in turning on the transistor Tr11. For example, the resistance ratio between the transistor Tr13 and the transistor Tr14 may be so adjusted by means of resistance division that the transistor Tr13 has a high resistance value and the transistor Tr14 has a low resistance value.

The enable signal to be supplied to the cut-off control line ck1 may make a transition to the Lo level before a time t5, fixing the voltage of the gate terminal A to the fixed voltage Vss2. The fixed voltage Vss2 may be −3 V, for example. The time t5 is a time that is 1 H after the time t4.

Operation

Next, an operation (an operation from a non-light-emission state to a light-emission state) of the display unit 1 according to the present example embodiment is described. The present example embodiment may involve a compensation operation addressing a variation in I-V characteristics of the organic EL element 13, to thereby maintain constant luminance of the organic EL element 13 without being influenced by the over-time variation in the I-V characteristics of the organic EL element 13. The present example embodiment may further involve a correction operation addressing a variation in factors such as the threshold voltage and the electron mobility of the driving transistor Tr1, to thereby maintain the constant luminance of the organic EL element 13 without being influenced by the over-time variation in the foregoing factors such as the threshold voltage and the electron mobility of the driving transistor Tr1.

Figure 6:
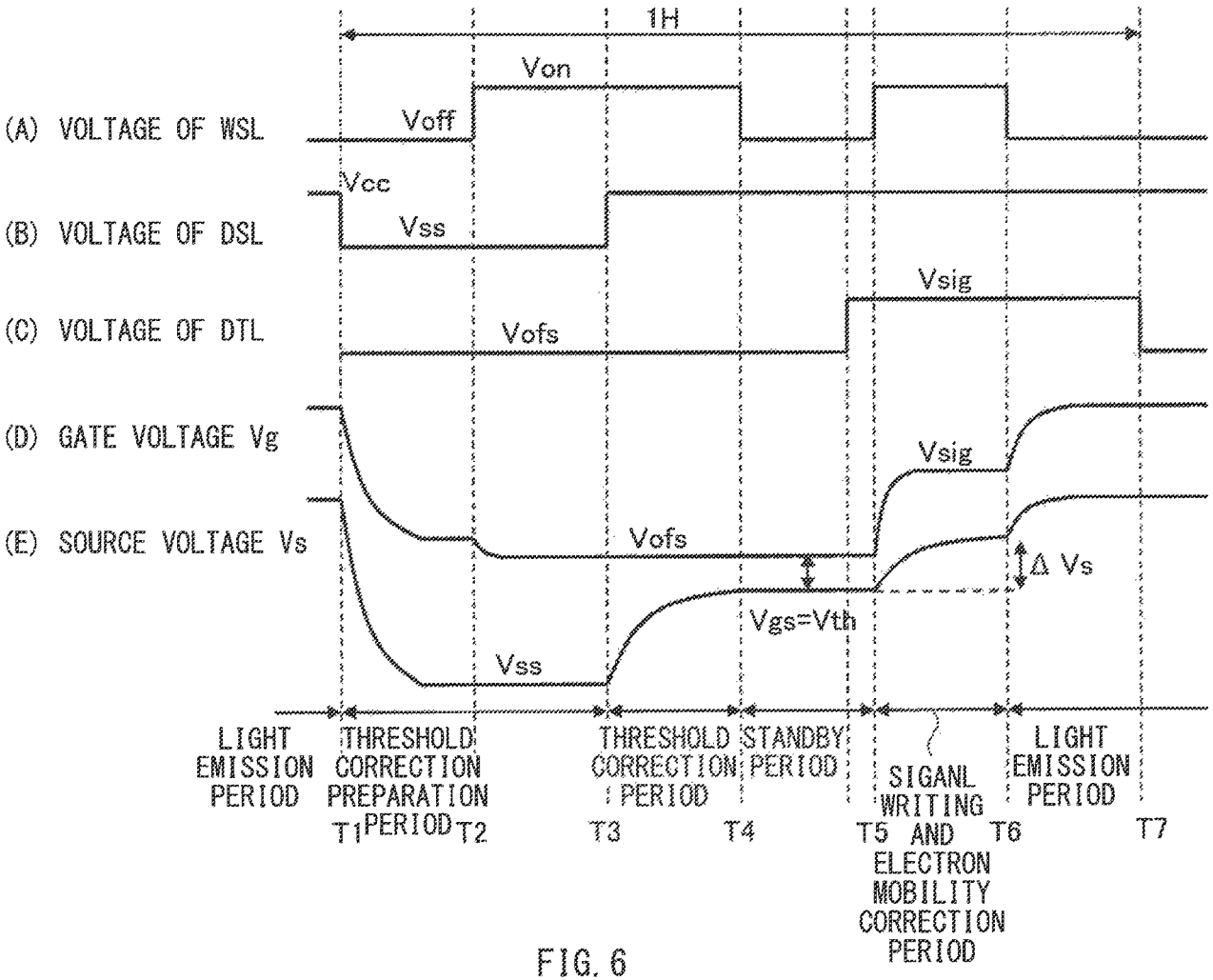
FIG. 6 illustrates an example of an operation of each pixel performed in a period from a non-light-emission state to a light-emission state.

FIG. 6 illustrates an example of an over-time variation in the voltage supplied to the signal line DTL, the voltage supplied to the scanning line WSL, the voltage supplied to the power line DSL, the gate voltage Vg of the driving transistor Tr1, and the source voltage Vs of the driving transistor Tr1, when focusing on one of the pixels 11.

(Threshold Correction Preparation Period)

First, the controller 20 and the driver 30 may perform threshold correction preparation in which the gate-source voltage Vgs of the driving transistor Tr1 is varied toward the threshold voltage of the driving transistor Tr1. More specifically, the power scanner 33 may decrease the voltage of the power line DSL from the voltage Vcc to the voltage Vss in response to the control signal, when the voltage of the scanning line WSL is the voltage Voff, the voltage of the signal line DTL is the voltage Vofs, and the voltage of the power line DSL is the voltage Vcc (in other words, when the organic EL element 13 is in the light-emission state) (T1). Accordingly, the source voltage Vs may be decreased to the voltage Vss, causing the organic EL element 13 to be in the non-light-emission state. Upon decrease in the source voltage Vs, the gate voltage Vg may be also decreased due to coupling between the gate terminal and the source terminal of the transistor Tr1 via the capacitor Cs1. Thereafter, the write scanner 32 may increase the voltage of the scanning line WSL from the voltage Voff to the voltage Von in response to the control signal (T2), while the voltage of the power line DSL is the voltage Vss and the voltage of the signal line DTL is the voltage Vofs. This may decrease the gate voltage Vg to the voltage Vofs.

(Threshold Correction Period)

Thereafter, the controller 20 and the driver 30 may perform threshold correction for the driving transistor Tr1. More specifically, the power scanner 33 may increase the voltage of the power line DSL from the voltage Vss to the voltage Vcc in response to the control signal (T3), while the voltage of the signal line DTL is the voltage Vofs and the voltage of the scanning line WSL is the voltage Von. This may allow a current to flow between the drain terminal and the source terminal of the driving transistor Tr1, increasing the source voltage Vs. When the source voltage Vs has a value lower than a value of a difference between the voltage Vofs and the voltage Vth (Vofs-Vth) (when the threshold correction is uncompleted), the current may keep flowing between the drain terminal and the source terminal of the driving transistor Tr1 until the driving transistor Tr1 is cut off (until the gate-source voltage Vgs reaches the voltage Vth). This may allow the gate voltage Vg to be maintained at the voltage Vofs, and increase the source voltage Vs. As a result, the capacitor Cs1 may be charged to have the voltage Vth, allowing the gate-source voltage Vgs to the voltage Vth.

Thereafter, the horizontal selector 31 may decrease the voltage of the scanning line WSL from the voltage Von to the voltage Voff in response to the control signal (T4), before switching the voltage of the signal line DTL from the voltage Vofs to the voltage Vsig in response to the control signal. This may allow the gate terminal of the driving transistor Tr1 to be in a floating state, allowing the gate-source voltage Vgs to be kept at the voltage Vth irrespective of the magnitude of the voltage of the signal line DTL. Thus setting the gate-source voltage Vgs to the voltage Vth makes it possible to suppress variations in light emission luminance between the organic EL elements 13 even when the threshold voltage Vth of the driving transistor Tr1 varies between the pixel circuits 12.

(Standby Period)

Thereafter, the horizontal selector 31 may switch the voltage of the signal line DTL from the voltage Vofs to the voltage Vsig in a standby period.

(Signal Writing and Electron Mobility Correction Period)

The controller 20 and the driver 30 may perform writing of the signal voltage Vsig based on the image signal Din and electron mobility correction after the standby period ends (i.e., after the threshold correction is completed). More specifically, the write scanner 32 may increase the voltage of the scanning line WSL from the voltage Voff to the voltage Von in response to the control signal (T5), thereby coupling the gate terminal of the driving transistor Tr1 to the signal line DTL, while the voltage of the signal line DTL is the voltage Vsig and the voltage of the power line DSL is the voltage Vcc. This may allow the gate voltage Vg of the driving transistor Tr1 to be varied to the voltage Vsig of the signal line DTL. An anode voltage of the organic EL element 13 is lower than the threshold voltage Vel of the organic EL element 13 in this phase, and the organic EL element 13 is cut off. Accordingly, a gate-source current may flow to a capacitor Coled of the organic EL element 13, charging the capacitor Coled. This may increase the source voltage Vs by ΔVs, leading the gate-source voltage Vgs to be a voltage obtained by subtracting ΔVs from the sum of the voltage Vsig and the voltage Vth (Vsig+Vth−ΔVs). The writing of the signal voltage Vsig and the electron mobility correction are thus performed at the same time. It is to be noted that ΔVs is larger as the electron mobility of the driving transistor Tr1 is larger. It is therefore possible to suppress variations in electron mobility between the pixels 11 by decreasing the gate-source voltage Vgs by ΔV before achievement of the light-emission state.

(Light Emission Period)

Lastly, the write scanner 32 may decrease the voltage of the scanning line WSL from the voltage Von to the voltage Voff in response to the control signal (T6). This allows the gate terminal of the driving transistor Tr1 to be in the floating state, allowing a current Ids to flow between the drain terminal and the source terminal of the driving transistor Tr1. This may increase the source voltage Vs. As a result, the organic EL element 13 receives a voltage that is equal to or higher than the threshold voltage Vel, causing the organic EL element 13 to emit light at a desired luminance.

Effects

Next, effects of the display unit 1 according to the present example embodiment are described, making a comparison with a comparative example.

Figure 7:
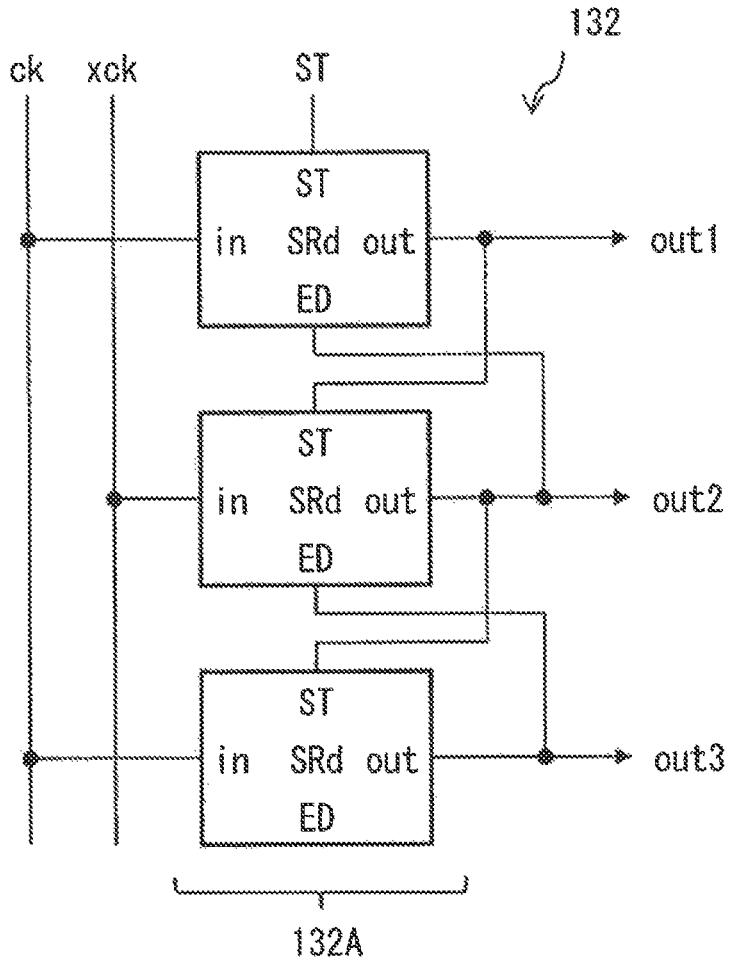
FIG. 7 illustrates an example of a circuit configuration of a write scanner according to a comparative example.

FIG. 7 illustrates an example of a circuit configuration of a write scanner 132 according to the comparative example. The write scanner 132 includes a shift register circuit 132A and two clock lines ck and xck. The shift register circuit 132A includes a plurality of register circuits SRd. The two clock lines ck and xck are coupled to the shift register circuit 132A. An input terminal in of each of odd-numbered register circuits SRd included in the plurality of register circuits SRd is coupled to the clock line ck. An input terminal in of each of even-numbered register circuits SRd included in the plurality of register circuits SRd is coupled to the clock line xck. An output terminal out of each of the plurality of register circuits SRd is coupled to a start terminal ST of a subsequent register circuit SRd, and is also coupled to an end terminal ED of a preceding register circuit SRd.

Figure 8:
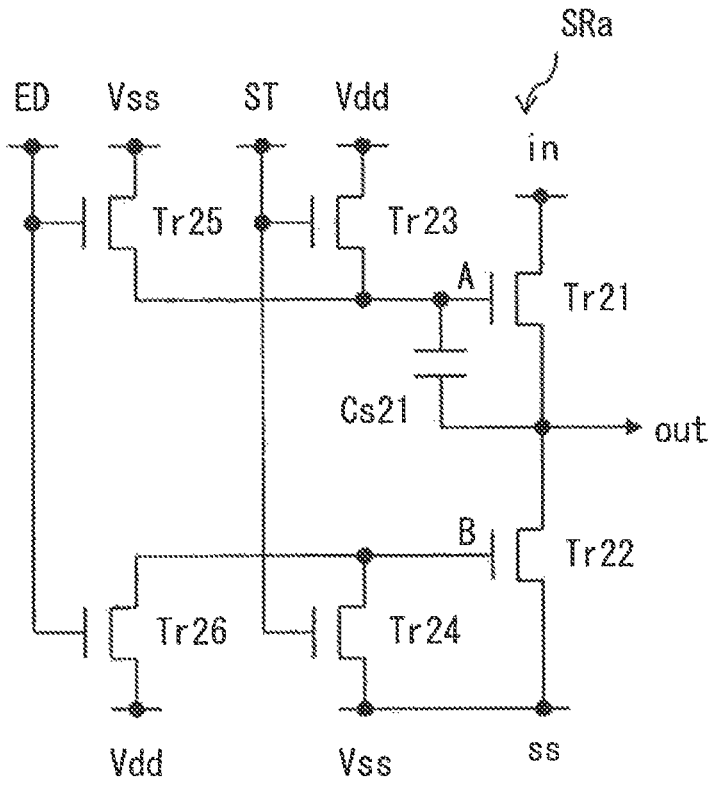
FIG. 8 illustrates an example of a circuit configuration of a register circuit according to the comparative example.

FIG. 8 illustrates an example of a circuit configuration of any one of the register circuits SRd illustrated in FIG. 7. The register circuit SRd includes an output circuit, a start circuit, and a stop circuit. The output circuit includes transistors Tr21 and Tr22 and a capacitor Cs21. The start circuit includes transistors Tr23 and Tr24. The stop circuit includes transistors Tr25 and Tr26. The transistors Tr21 and Tr22 are coupled to each other in series between the input terminal in and the power terminal ss. A coupling point of the transistors Tr21 and Tr22 serves as the output terminal out. The capacitor Cs21 is coupled between a gate terminal and a source terminal of the transistor Tr21. The transistors Tr23 and Tr25 are coupled to each other in parallel, and are each coupled to the gate terminal A of the transistor Tr21. The transistors Tr24 and Tr26 are coupled to each other in parallel, and are each coupled to a gate terminal B of the transistor Tr22. Gate terminals of the respective transistors Tr23 and Tr24 are coupled to the start terminal ST. Gate terminals of the transistors Tr25 and Tr26 are coupled to the end terminal ED.

Figure 9:
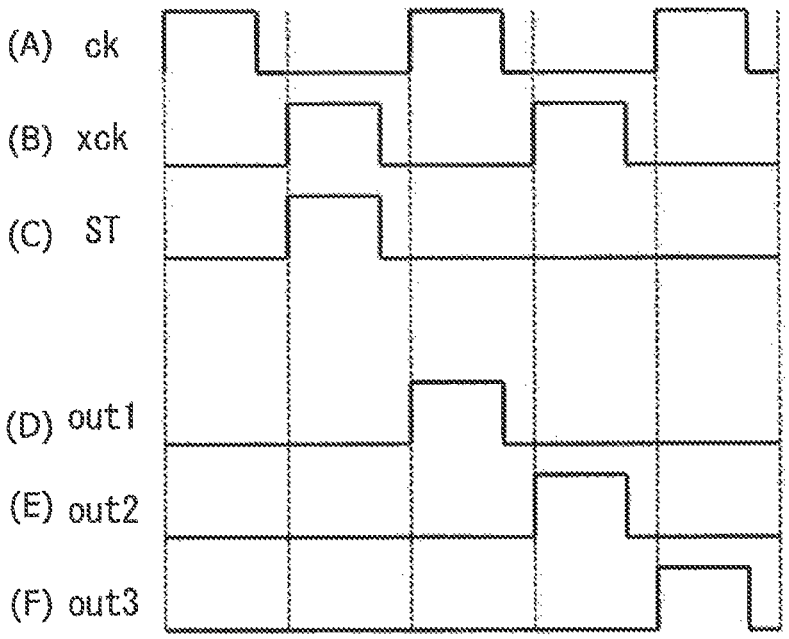
FIG. 9 illustrates an example of input and output waveforms of a shift register circuit according to the comparative example.

FIG. 9 illustrates an example of input and output waveforms of the register circuit SRd illustrated in FIG. 7. Part (A) of FIG. 9 illustrates an example of a control signal that is supplied to the clock line ck. Part (B) of FIG. 9 illustrates an example of a control signal that is supplied to the clock line xck. Part (C) of FIG. 9 illustrates an example of a control signal that is supplied to the start terminal ST. Part (D) of FIG. 9 illustrates an example of a signal that is outputted from an output terminal out1 of a first register circuit SRd included in the shift register circuit 132A. Part (E) of FIG. 9 illustrates an example of a signal that is outputted from an output terminal out2 of a second register circuit SRd included in the shift register circuit 132A. Part (F) of FIG. 9 illustrates an example of a signal that is outputted from an output terminal out3 of a third register circuit SRd included in the shift register circuit 132A.

Figure 10:
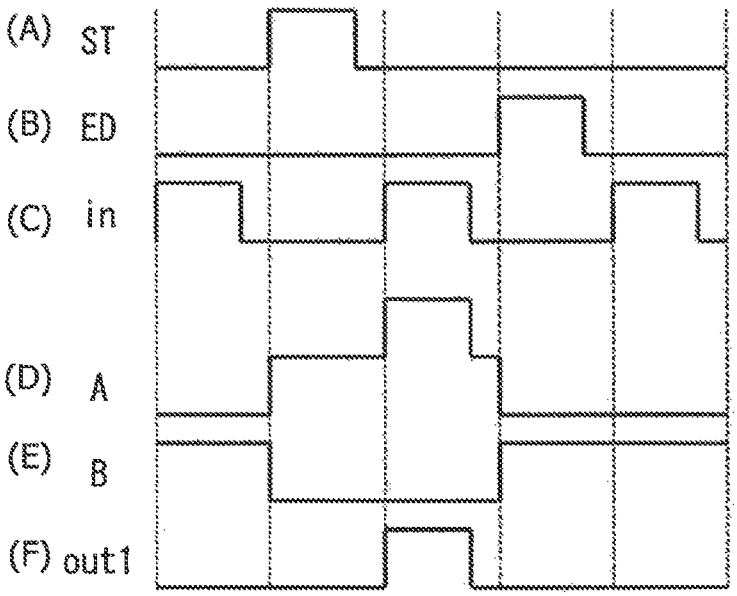
FIG. 10 illustrates another example of the input and output waveforms of the shift register circuit according to the comparative example.

FIG. 10 illustrates another example of input and output waveforms of the register circuit SRd illustrated in FIG. 7. Part (A) of FIG. 10 illustrates an example of the control signal that is supplied to the start terminal ST. Part (B) of FIG. 10 illustrates an example of a control signal that is supplied to the end terminal ED. Part (C) of FIG. 10 illustrates an example of a control signal that is supplied to the clock line ck (the input terminal in). Part (D) of FIG. 10 illustrates an example of a signal that is supplied to the gate terminal A of the transistor Tr21. Part (E) of FIG. 10 illustrates an example of a signal that is supplied to the gate terminal B of the transistor Tr22. Part (F) of FIG. 10 illustrates an example of the signal that is outputted from the output terminal out1 of the first register circuit SRd included in the shift register circuit 132A.

A two-phase clock signal is supplied to the respective two clock lines ck and xck, according to the comparative example. The start terminal ST of the first register circuit SRd receives a start pulse, allowing the gate terminal A to receive a voltage at the Hi level, i.e., the voltage Vdd. Thereafter, the clock line ck receives the clock signal, turning on the transistor Tr21, and allowing the output terminal out1 of the first register circuit SRd to output a pulse corresponding to the start pulse. Thereafter, supply of the clock signal to the clock line ck is stopped, causing a signal output from the output terminal out1 to be stopped.

The foregoing register circuit SRd may involve occurrence of leakage of a current from the gate terminal A via the transistor Tr25, for example, when the pulse corresponding to the start pulse is outputted from the output terminal out1 of the first register circuit SRd. The leakage of the current may lead to a decrease in signal output from the output terminal out1. The decrease in signal output from the output terminal out1 may lead to insufficient oscillation of the signal output, making it difficult to perform matrix driving of the respective pixels 11.

In contrast, the transistor Tr13 may be provided in the electrically-conductive path p3 which serves as a path for transmitting the input signal, according to the present example embodiment. Further, the transistor Tr15, that is turned on or off in response to reception of the input signal, may be provided in the electrically-conductive path p4 between the clock terminal onck and the gate terminal of the transistor Tr13. This suppresses a through current that flows from the input terminal in to the power terminal ss2, compared to a configuration without the transistor Tr15. Further, the transistor Tr13 has high resistance while the transistor Tr15 is turned off, suppressing the through current that flows from the input terminal in to the power terminal ss2. As a result, it is possible to reduce a failure in operation due to leakage of a current.

Moreover, it is possible to simplify the manufacturing process when the present example embodiment has a configuration in which each of the transistors Tr11 to Tr16 is an n-channel MOS TFT.

2. Modifications

Various modifications of the display unit 1 of the present example embodiment are described below. It is to be noted that the components same as those in the display unit 1 of the foregoing example embodiment are referred to with the same numerals, and will not be further described where appropriate.

Modification A

The foregoing example embodiment may be so modified as to achieve a configuration in which the power scanner 33 includes the shift register circuit 32A. Further, the plurality of power lines DSL may each receive a fixed voltage, whereas the plurality of power lines DSL may be scanned by the power scanner 33 in the foregoing example embodiment. However, in the modification in which the plurality of power lines DSL receive the fixed voltage, the controller 20 and the driver 30 may supply each of the plurality of scanning lines WSL and the plurality of signal lines DTL with a voltage that is so adjusted as to allow for operations such as the threshold correction, the electron mobility correction, and the signal writing, even when all of the power lines DSL have the fixed voltage. Allowing the power scanner 33 to include the shift register circuit 32A in the present modification makes it possible to reduce a failure in operation due to leakage of a current in the power scanner 33.

Modification B

Figure 11:
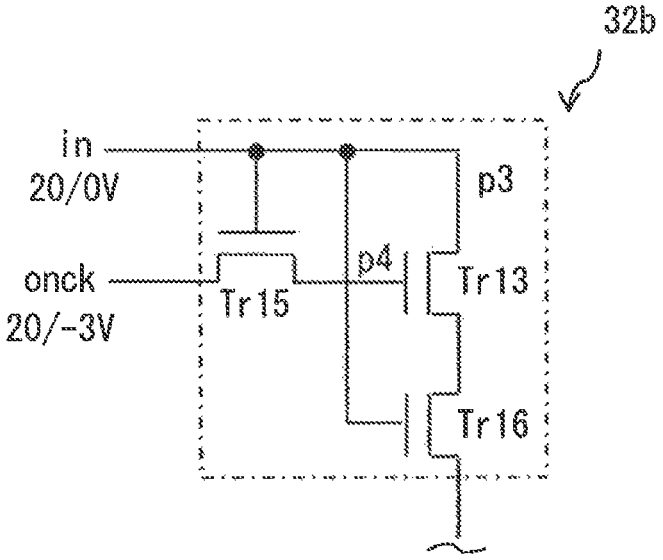
FIG. 11 illustrates an example of a circuit configuration of an input circuit.

The foregoing example embodiment may be so modified as to achieve a configuration in which the input circuit 32*b* further includes a transistor Tr16 in the electrically-conductive path p3 as illustrated in FIG. 11, for example. The transistor Tr16 may correspond to a "sixth transistor" in one specific but non-limiting embodiment of the technology. The transistor Tr16 may be provided at a position that is closer to the gate terminal of the transistor Tr11 than the transistor Tr13 in the electrically-conductive path p3, and have a gate terminal that is coupled to the input terminal in, for example. In this modification, the transistor Tr16 may be preferably an n-channel MOS TFT as with the other transistors (such as the transistor Tr11). This configuration allows the voltage of the gate terminal A of the transistor Tr11 to be determined on the basis of resistance division between the transistors Tr13, Tr16, and Tr14. Accordingly, the present modification makes it possible to effectively suppress an amount of an increase in the voltage of the gate terminal A of the transistor Tr11 due to the through current, by setting the resistance division between the transistors Tr13, Tr16, and Tr14. As a result, it is possible to reduce a failure in operation due to leakage of a current.

Modification C

Figure 12:
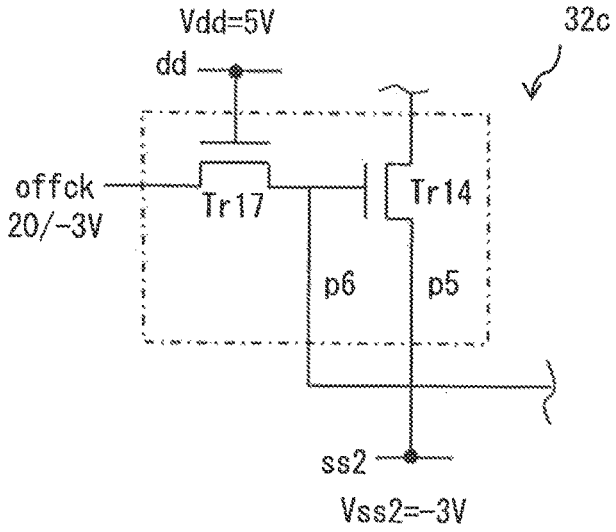
FIG. 12 illustrates an example of a circuit configuration of a reset circuit.

The foregoing example embodiment may be so modified as to achieve a configuration in which the reset circuit 32*c* further includes a transistor Tr17 in the electrically-conductive path p5 as illustrated in FIG. 12, for example. The transistor Tr17 may be provided at a position between the gate terminal of the transistor Tr14 and the clock terminal offck in the electrically-conductive path p5, and have a gate terminal that is coupled to the power terminal dd. The power circuit 23 may supply the voltage Vdd of 5 V to the power terminal dd, for example. The present modification may have the configuration in which the transistor Tr17 is provided in the electrically-conductive path p5. This configuration may allow the gate terminal of each of the transistors Tr12 and Tr14 to receive a voltage of 5 V, which is a voltage corresponding to a difference between the voltage Vdd and the voltage Vth (Vdd−Vth=5−(0)=5 V), when a threshold voltage of the transistor Tr17 is 0 (zero) V, for example. In contrast, the gate terminal of each of the transistors Tr12 and Tr14 receives a voltage at a Hi level (20 V) of the clock terminal offck, in a configuration without provision of the transistor Tr17 in the electrically-conductive path p5. That is, provision of the transistor Tr17 in the electrically-conductive path p5 suppresses the voltage to be supplied to the gate terminal of each of the transistors Tr12 and Tr14. As a result, degradation of characteristics (a variation in threshold) of each of the transistors Tr12 and Tr14 is suppressed, improving reliability of each of the transistors Tr12 and Tr14.

Modification D

Figure 13:
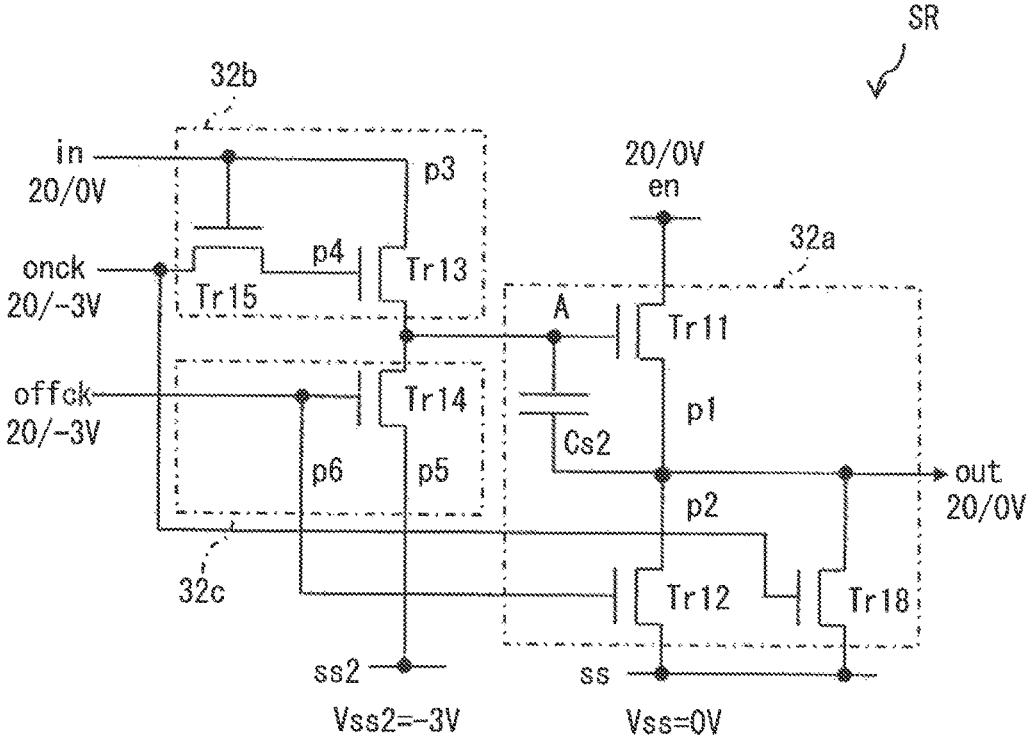
FIG. 13 illustrates an example of a circuit configuration of the register circuit.

The foregoing example embodiment may be so modified as to achieve a configuration in which the output circuit 32*a* further includes a transistor Tr18 as illustrated in FIG. 13, for example. The transistor Tr18 may be coupled to the transistor Tr12 in parallel. The transistor Tr18 may be provided between the output terminal out and the power terminal ss. One of a source terminal and a drain terminal of the transistor Tr18 may be coupled to the output terminal out, and the other of the source terminal and the drain terminal, which is not coupled to the output terminal out, of the transistor Tr18 may be coupled to the power terminal ss. A gate terminal of the transistor Tr18 may be coupled to the clock terminal onck.

The present modification may have the configuration in which the gate terminal of the transistor Tr18, which is coupled to the transistor Tr12 in parallel, is coupled to the clock terminal onck. This configuration may allow the output terminal out to have the fixed voltage Vss, when the input terminal in of the register circuit SR1 receives the input signal st, and the cut-off control line ck1 receives the clock signal, setting the gate terminal A of the register circuit SR1 to the Hi level, at the time t1, for example. This suppresses crosstalk of the clock signal into the output terminal out which may occur under the floating state of the output terminal out. As a result, a noise in the output waveform outputted from the output terminal out is reduced, suppressing an error in the operation of the register circuit SR1. This allows for a stable operation of the register circuit SR1.

Moreover, the present modification may have a configuration in which the input circuit 32*b* further includes the transistor Tr16 described above referring to the foregoing modification B. This reduces a failure in operation due to leakage of a current. Further, the present modification may have a configuration in which the reset circuit 32*c* further includes the transistor Tr17 described above referring to the foregoing modification C. This configuration may allow the gate terminal of each of the transistors Tr12 and Tr14 to receive the voltage of 5 V, which is a voltage corresponding to a difference between the voltage Vdd and the voltage Vth (Vdd−Vth=5−(0)=5 V), when the threshold voltage of the transistor Tr17 is 0 (zero) V, for example. In contrast, the gate terminal of each of the transistors Tr12 and Tr14 receives the voltage at the Hi level (20 V) of the clock terminal offck, in the configuration without provision of the transistor Tr17 in the electrically-conductive path p5. That is, provision of the transistor Tr17 in the electrically-conductive path p5 suppresses the voltage to be supplied to the gate terminal of each of the transistors Tr12 and Tr14. As a result, degradation of characteristics (a variation in threshold) of each of the transistors Tr12 and Tr14 is suppressed, improving reliability of each of the transistors Tr12 and Tr14.

Modification E

Figure 14:
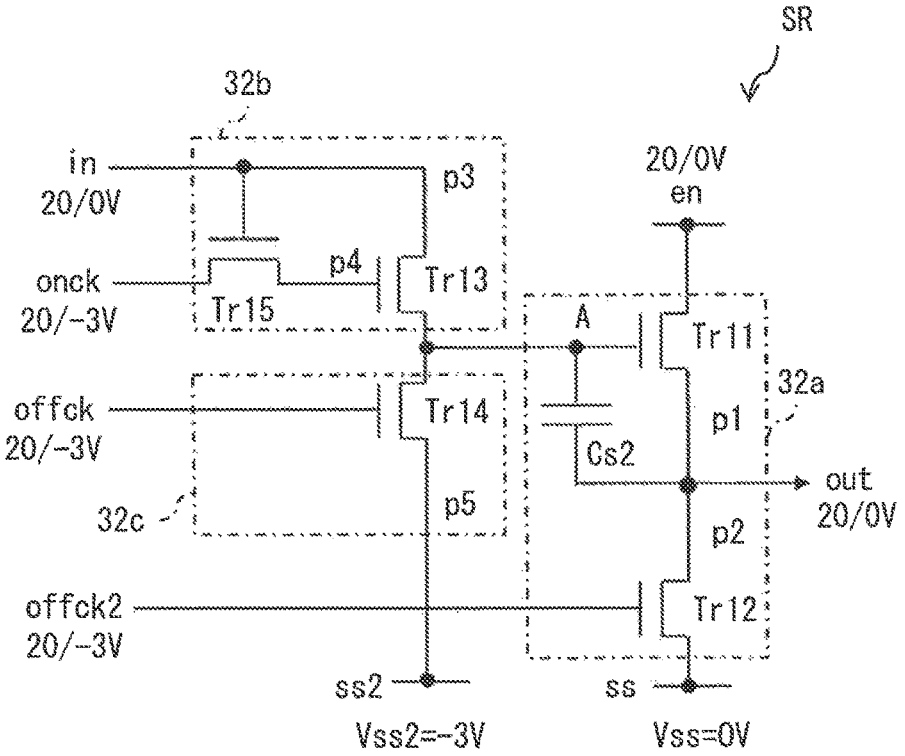
FIG. 14 illustrates another example of the circuit configuration of the register circuit.

The foregoing example embodiment may be so modified as to achieve a configuration in which the gate terminal of the transistor Tr12 is coupled to a line that is different from the line that is coupled to the gate terminal of the transistor Tr14 as illustrated in FIG. 14, for example. In this configuration, the timing generator circuit 22 may supply the gate terminal of the transistor Tr12 with a control signal that is the same as the control signal supplied to the gate terminal of the transistor Tr14. Alternatively, the timing generator circuit 22 may supply the gate terminal of the transistor Tr12 with a control signal having a phase that is substantially the same as the phase of the control signal supplied to the gate terminal of the transistor Tr14.

Modification F

Figure 15:
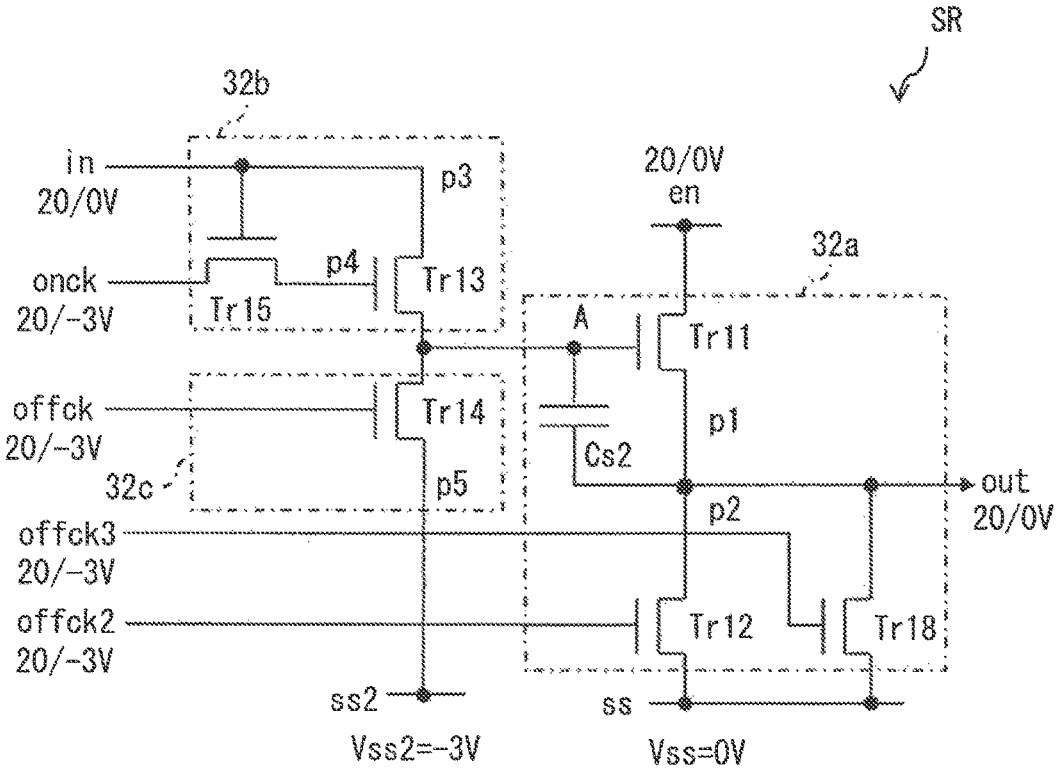
FIG. 15 illustrates another example of the circuit configuration of the register circuit.

The foregoing modification D may be further modified so as to achieve a configuration in which the gate terminal of the transistor Tr12 is coupled to a line that is different from the line that is coupled to the gate terminal of the transistor Tr14, and the gate terminal of the transistor Tr18 is coupled to a line that is different from the line that is coupled to the transistor Tr15, as illustrated in FIG. 15, for example. In this configuration, the timing generator circuit 22 may supply the gate terminal of the transistor Tr18 with a control signal that is the same as the control signal supplied to the gate terminal of the transistor Tr13 via the transistor Tr15. Alternatively, the timing generator circuit 22 may supply the gate terminal of the transistor Tr18 with a control signal having a phase that is substantially the same as the phase of the control signal supplied to the gate terminal of the transistor Tr13 via the transistor Tr15.

Modification G

Figure 16:
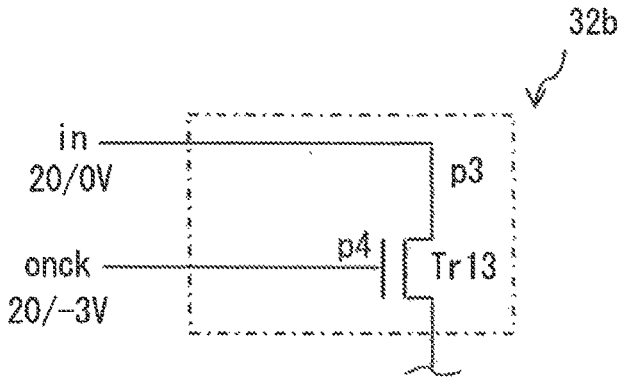
FIG. 16 illustrates another example of the circuit configuration of the input circuit.

The foregoing example embodiment may be so modified as to achieve a configuration in which the transistor Tr15 is not provided as illustrated in FIG. 16, for example. The transistor Tr13 is turned on or off in response to the control signal supplied to the clock terminal onck also in this configuration. Accordingly, a through current that flows from the input terminal in to the power terminal ss2 is suppressed. As a result, it is possible to reduce a failure in operation due to leakage of a current.

Modification H

Figure 17:
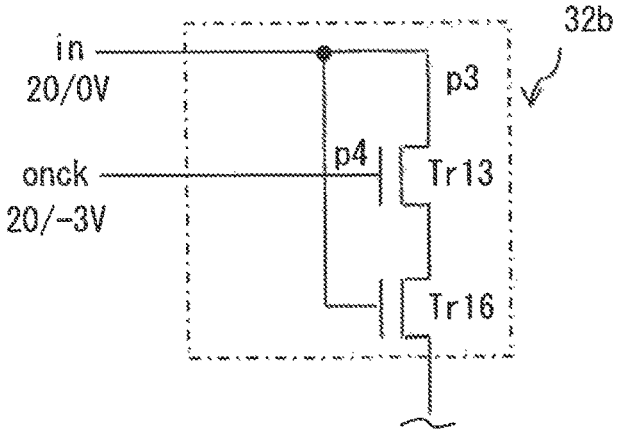
FIG. 17 illustrates another example of the circuit configuration of the input circuit.

The foregoing modification G may be further modified so as to achieve a configuration in which the input circuit 32*b* further includes the transistor Tr16 in the electrically-conductive path p3 as illustrated in FIG. 17, for example. The transistor Tr16 may be provided at a position that is closer to the gate terminal of the transistor Tr11 than the transistor Tr13 in the electrically-conductive path p3, and have a gate terminal that is coupled to the input terminal in, for example. The transistor Tr16 may be preferably an n-channel MOS TFT as with the other transistors (such as the transistor Tr11). This configuration allows the voltage of the gate terminal A of the transistor Tr11 to be determined on the basis of resistance division between the transistors Tr13, Tr16, and Tr14. Accordingly, the present modification makes it possible to effectively suppress the amount of the increase in the voltage of the gate terminal A of the transistor Tr11 due to the through current, by setting the resistance division between the transistors Tr13, Tr16, and Tr14. As a result, it is possible to reduce a failure in operation due to leakage of a current.

3. Second Example Embodiment

Configuration

Figure 18:
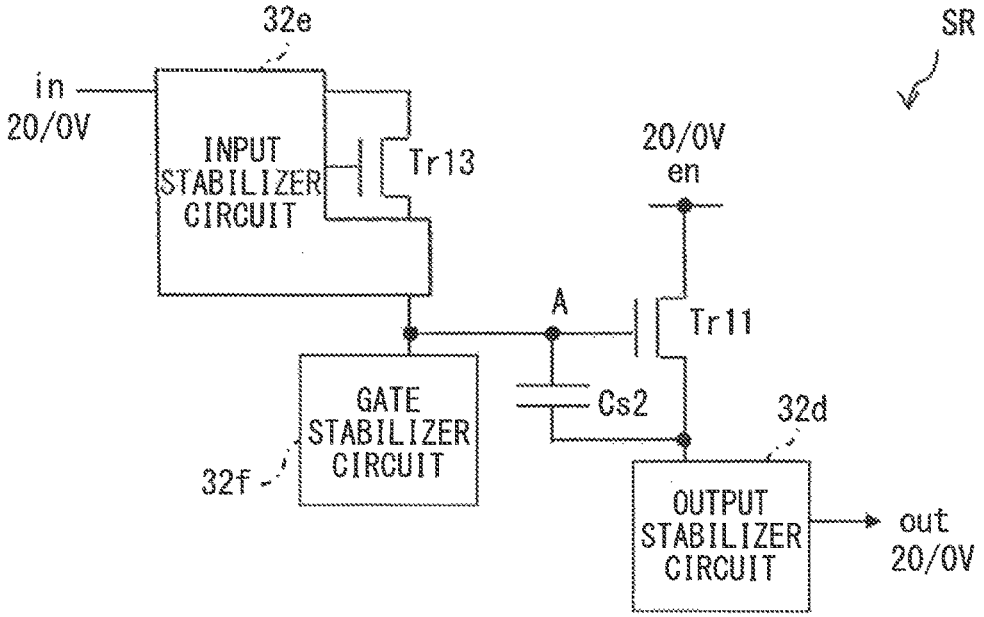
FIG. 18 illustrates an example of a circuit configuration of a register circuit in a display unit according to a second example embodiment of the technology.

Next, a display unit according to a second example embodiment of the technology is described. The display unit according to the present example embodiment has a configuration that corresponds to the configuration of the display unit 1 according to any of the foregoing example embodiment and the foregoing modifications thereof, in which each of the register circuits SR included in the write scanner 32 is replaced by a register circuit having a configuration illustrated in FIG. 18. According to the present example embodiment, the register circuits SR may each include the transistor Tr13, the transistor Tr11, and the capacitor Cs2. The transistor Tr13 may receive the input signal. The transistor Tr11 may output a signal that is in synchronization with the input signal supplied to the transistor Tr13. The capacitor Cs2 may hold a gate-source voltage of the transistor Tr13. The plurality of register circuits SR, except for the first register circuit SR, may each have a configuration in which the drain terminal of the transistor Tr13 receives, as the input signal, the output signal outputted from the preceding register circuit SR. Each of the register circuits SR may further include an output stabilizer circuit 32*d*, an input stabilizer circuit 32*e*, and a gate stabilizer circuit 32*f* The transistor Tr13 may correspond to an "input transistor" in one specific but non-limiting embodiment of the technology. The transistor Tr11 may correspond to an "output transistor" in one specific but non-limiting embodiment of the technology.

Figure 19:
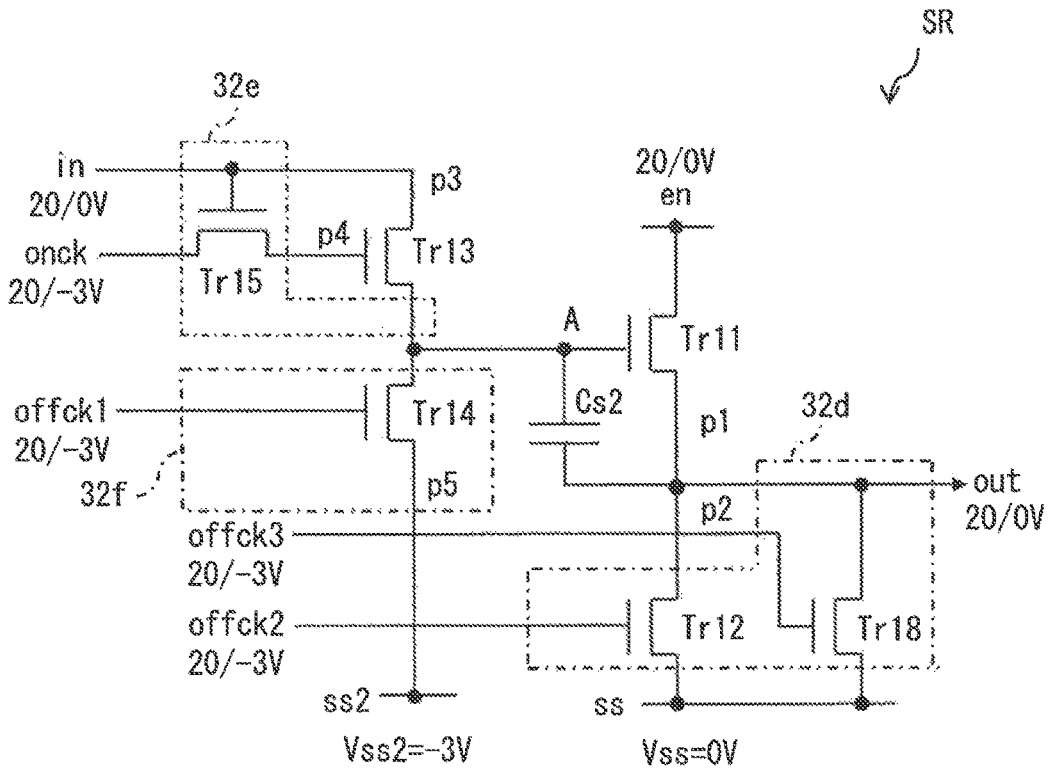
FIG. 19 illustrates an example of a circuit configuration of the register circuit.

The display unit of the present example embodiment may have a configuration that corresponds to the configuration of the display unit 1 of the foregoing modification D, in which the respective components included in the register circuit SR illustrated in FIG. 13 are re-grouped into a plurality of functional blocks illustrated in FIG. 19, for example.

Figure 20:
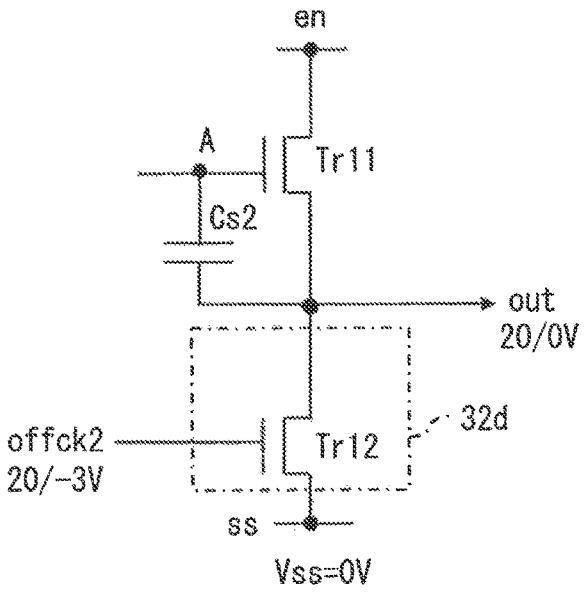
FIG. 20 illustrates an example of a circuit configuration of an output stabilizer circuit.

Each of the register circuits SR may include the output stabilizer circuit 32*d* that stabilizes the voltage to be outputted from the output terminal out when the transistor Tr13 is turned off, on the basis of the clock signal supplied from the timing generator circuit 22. The output stabilizer circuit 32*d* may include the transistors Tr12 and Tr18 as illustrated in FIG. 19, for example. Alternatively, the output stabilizer circuit 32*d* may include only the transistor Tr12 and may not include the transistor Tr18 as illustrated in FIG. 20, for example.

Each of the register circuits SR may include the input stabilizer circuit 32*e* that stabilizes the gate voltage of the transistor Tr13 when the transistor Tr13 is turned off, on the basis of the clock signal supplied from the timing generator circuit 22. The input stabilizer circuit 32*e* may include the transistor Tr15 provided in the electrically-conductive path p4 between the gate terminal of the transistor Tr13 and the clock terminal onck that receives the clock signal. The input stabilizer circuit 32*e* may include the transistors Tr15 and Tr16, for example. The transistor Tr16 may be coupled to the transistor Tr13 in series, and have the gate terminal that receives the output signal outputted from the preceding register circuit SR. The transistor Tr15 may correspond to a "first control transistor" in one specific but non-limiting embodiment of the technology. The transistor Tr16 may correspond to a "second control transistor" in one specific but non-limiting embodiment of the technology.

Each of the register circuits SR may include the gate stabilizer circuit 32*f* that stabilizes the gate voltage of the transistor Tr11 when the transistor Tr13 is turned off, on the basis of the clock signal supplied from the timing generator circuit 22. The gate stabilizer circuit 32*f* may include the transistor Tr14 as illustrated in FIG. 19, for example. Alternatively, the gate stabilizer circuit 32*f* may include the transistors Tr14 and Tr17 as illustrated in FIG. 12, for example.

According to the present example embodiment, the power circuit 23 may supply the voltage Vss (=0 (zero) V) to the power terminal ss, and supply the voltage Vss2 (=−3 V) to the power terminal ss2, for example. The power circuit 23 may supply the power terminal ss2 with the voltage (Vss2) that is lower than the voltage (Vss) supplied to the power terminal ss, for example. The timing generator circuit 22 may output, as the Lo level of the clock signal, a voltage that is lower than the voltage Vss supplied to the power terminal ss. The second and subsequent register circuits SR may each have the input terminal in that is coupled to the output terminal out of the preceding register circuit SR. The timing generator circuit 22 in each of the second and subsequent register circuits SR may supply the clock terminal onck with a clock signal having a phase that is the same as the phase of the signal supplied to the input terminal in.

According to the present example embodiment, the timing generator circuit 22 may supply the clock signal to the cut-off control line ck3, thereby resetting the voltage of the gate terminal A of the register circuit SR to the Lo level (for example, −3 V) that is a negative voltage lower than the voltage Vss, at the time t3 in FIG. 5. For example, the timing generator circuit 22 may reset the voltage of the gate terminal A to the Lo level that is a negative voltage lower than the voltage Vss by the threshold voltage of the transistor Tr11. Upon resetting the voltage of the gate terminal A, the power circuit 23 may supply each of the power terminal ss2 and the control terminals onck and offck with the voltage at the Lo level (for example, −3 V) that is the negative voltage lower than the voltage Vss. This allows a voltage corresponding to a difference between the voltage at the Lo level and the voltage Vss (Lo−Vss2) to be supplied between the gate terminal and the source terminal of the transistor Tr13. For example, the power circuit 23 may supply each of the power terminal ss2 and the control terminals onck and offck with the voltage at the Lo level (for example, −3 V) that is the negative voltage lower than the voltage Vss by the threshold voltage of the transistor Tr11. This allows a voltage corresponding to a difference between the voltage at the Lo level and the voltage Vss (Lo−Vss2) to be supplied between the gate terminal and the source terminal of the transistor Tr13. This suppresses the through current that flows from the input terminal in to the power terminal ss2, compared to the configuration without the transistor Tr15. Further, the transistor Tr13 has high resistance while the transistor Tr15 is turned off, suppressing the through current that flows from the input terminal in to the power terminal ss2. As a result, it is possible to reduce a failure in operation due to leakage of a current.

Figure 21:
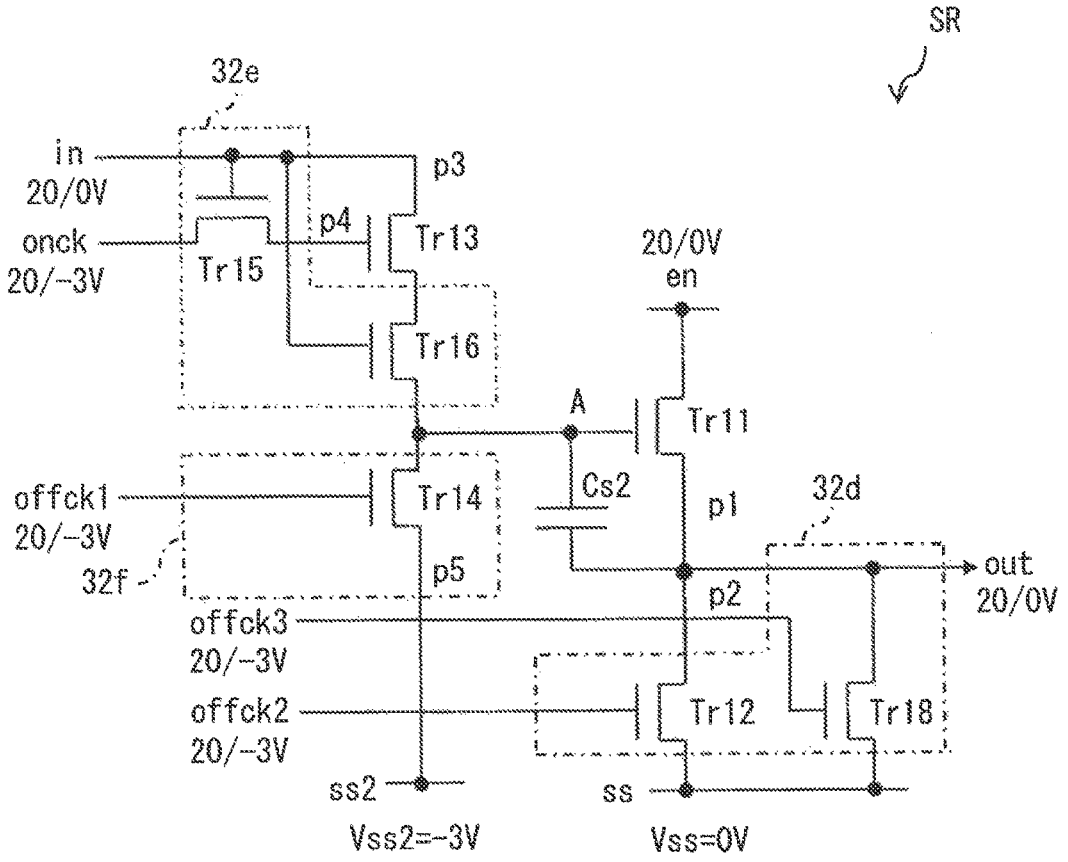
FIG. 21 illustrates another example of the circuit configuration of the register circuit.

When the present example embodiment has a configuration in which the transistor Tr13 is a depletion-mode n-channel MOS TFT, the input stabilizer circuit 32*e* may preferably include the transistors Tr15 and Tr16 as illustrated in FIG. 21. This configuration allows the voltage of the gate terminal A of the transistor Tr11 to be determined on the basis of resistance division between the transistors Tr13, Tr16, and Tr14. Accordingly, the present modification makes it possible to effectively suppress the amount of the increase in the voltage of the gate terminal A of the transistor Tr11 due to the through current, by setting the resistance division between the transistors Tr13, Tr16, and Tr14. As a result, it is possible to reduce a failure in operation due to leakage of a current.

3. Application Examples

A description is given below of an application example of the display unit 1 described above referring to the example embodiments and the modifications thereof (hereinafter, collectively referred to as "the foregoing example embodiments, etc."). The display unit 1 according to any of the foregoing example embodiments, etc. is applicable to a display unit of an electronic apparatus in various fields that displays, as an image or a video, an image signal that is supplied from outside or is generated inside. Non-limiting examples of the electronic apparatus may include a television apparatus, a digital camera, a laptop personal computer, a mobile terminal apparatus such as a mobile phone, and a video camera.

Figure 22:
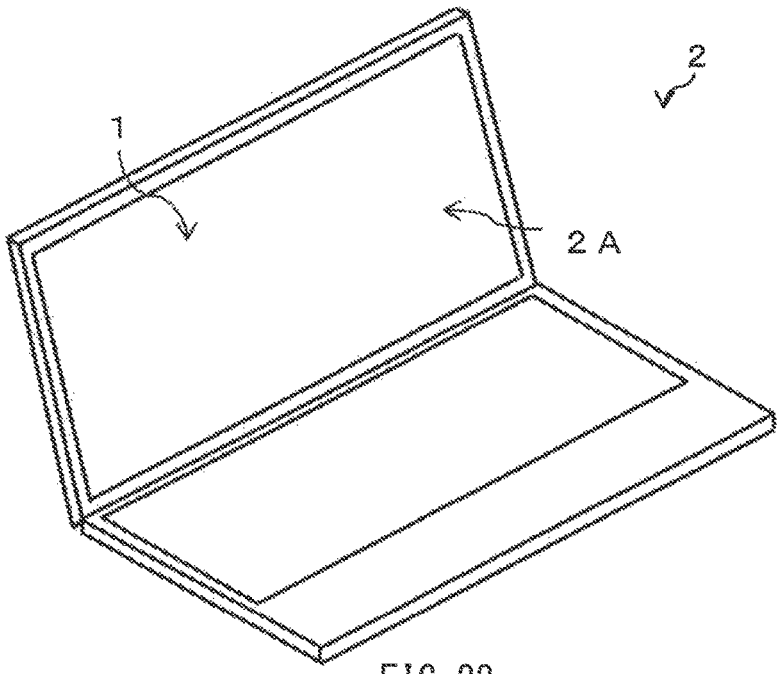
FIG. 22 is a perspective view of an appearance of an application example to which the display unit according to any of the foregoing example embodiments is applied.

FIG. 22 illustrates an outline configuration example of an electronic apparatus 2 according to the present application example. The electronic apparatus 2 may be a laptop personal computer that includes a display surface 2A provided on a main surface of one of two foldable plate-shaped housings, for example. The electronic apparatus 2 includes the display unit 1 according to the foregoing example embodiments, etc. The electronic apparatus 2 may include a pixel array section 10 at a location corresponding to the display surface 2A. The present application example involves provision of the display unit 1, making it possible to suppress power consumption of a battery.

The technology has been described above referring to the example embodiments, the modifications thereof, and the application example thereof. However, the technology is not limited to the foregoing example embodiments, etc., and may be variously modified. It is to be noted that the effects described herein are mere examples. The effects of the technology are not limited to the effects described herein. The technology may have effects other than the effects described herein.

For example, any of the foregoing example embodiments, the foregoing modifications, and the foregoing application example may have a configuration in which each of the pixels 11 may be an optical modulation element such as a liquid crystal cell.

It is possible to achieve at least the following configurations from the above-described example embodiments of the invention.

(1)

A register circuit, including:

an output circuit including a first transistor and a second transistor, the first transistor being provided in a first electrically-conductive path between a first control terminal and an output terminal, and the second transistor being provided in a second electrically-conductive path between a first power terminal and the output terminal; and an input circuit including a third transistor and a fourth transistor, the third transistor being provided in a third electrically-conductive path between an input terminal and a gate terminal of the first transistor, and the fourth transistor being provided in a fourth electrically-conductive path between a second control terminal and a gate terminal of the third transistor and having a gate terminal that is coupled to the input terminal.

(2)

The register circuit according to (1), further including a reset circuit including a fifth transistor, the fifth transistor being provided in a fifth electrically-conductive path between a second power terminal and the gate terminal of the first transistor.

(3)

The register circuit according to (2), wherein each of the first transistor, the second transistor, the third transistor, the fourth transistor, and the fifth transistor is an n-channel metal-oxide-semiconductor thin film transistor.

(4)

The register circuit according to (2) or (3), wherein the input circuit further includes a sixth transistor coupled to the third transistor in series in the third electrically-conductive path and coupled to the fifth transistor in series, the six transistor having a gate terminal that is coupled to the input terminal.

(5)

The register circuit according to any one of (1) to (4), wherein the output circuit further includes a capacitor that holds a potential difference between the gate terminal of the first transistor and the output terminal. (6)

The register circuit according to any one of (2) to (4), wherein the second transistor has a gate terminal that is coupled to a gate terminal of the fifth transistor, and the output circuit further includes a transistor that is coupled to the second transistor in parallel and has a gate terminal that is coupled to the second control terminal.

(7)

A driver circuit, including:

a shift register circuit including a plurality of register circuits that are coupled in series and include a plurality of first register circuits; and a plurality of control signal lines that are coupled to the shift register circuit, the plurality of first register circuits each including a first output circuit and a first input circuit, the first output circuit including a first transistor and a second transistor, the first transistor being provided in a first electrically-conductive path between a first control terminal and a first output terminal, the first control terminal being coupled to a first control signal line included in the plurality of control signal lines, and the second transistor being provided in a second electrically-conductive path between a first power terminal and the first output terminal, and the first input circuit including a third transistor and a fourth transistor, the third transistor being provided in a third electrically-conductive path between a first input terminal and a gate terminal of the first transistor, the fourth transistor being provided in a fourth electrically-conductive path between a second control terminal and a gate terminal of the third transistor and having a gate terminal that is coupled to the first input terminal, and the second control terminal being coupled to a second control signal line included in the plurality of control signal lines.

(8)

The driver circuit according to (7), further including a first reset circuit including a fifth transistor and a sixth electrically-conductive path, the fifth transistor being provided in a fifth electrically-conductive path between a second power terminal and the gate terminal of the first transistor, the sixth electrically-conductive path coupling a third control terminal and a gate terminal of the fifth transistor to each other, and the third control terminal being coupled to a third control signal line included in the plurality of control signal lines.

(9)

The driver circuit according to (8), wherein the plurality of control signal lines further include a fourth control signal line, a fifth control signal line, and a sixth control signal line in addition to the first control signal line, the second control signal line, and the third control signal line, the plurality of register circuits include a plurality of second register circuits and a plurality of third register circuits in addition to the plurality of first register circuits, the plurality of second register circuits each being coupled to the second control signal line, the fourth control signal line, and the fifth control signal line, and the plurality of third register circuits each being coupled to the third control signal line, the fifth control signal line, and the sixth control signal line.

(10)

The driver circuit according to (9), wherein the plurality of second register circuits each include a second output circuit, a second input circuit, and a second reset circuit, and the plurality of third register circuits each include a third output circuit, a third input circuit, and a third reset circuit, the second output circuit including a seventh transistor and an eighth transistor, the seventh transistor being provided in a seventh electrically-conductive path between a fourth control terminal and a second output terminal, the fourth control terminal being coupled to the fourth control signal line, the eighth transistor being provided in an eighth electrically-conductive path between a third power terminal and the second output terminal, the second input circuit including a ninth transistor and a tenth transistor, the ninth transistor being provided in a ninth electrically-conductive path between a second input terminal and a gate terminal of the seventh transistor, the tenth transistor being provided in a tenth electrically-conductive path between a fifth control terminal and a gate terminal of the ninth transistor, the fifth control terminal being coupled to the fifth control signal line, the second reset circuit including an eleventh transistor and a twelfth electrically-conductive path, the eleventh transistor being provided in an eleventh electrically-conductive path between a fourth power terminal and the gate terminal of the seventh transistor, the twelfth electrically-conductive path coupling a sixth control terminal and a gate terminal of the eleventh transistor to each other, the third output circuit including a twelfth transistor and a thirteenth transistor, the twelfth transistor being provided in a thirteenth electrically-conductive path between a seventh control terminal and a third output terminal, the seventh control terminal being coupled to the sixth control signal line, the thirteenth transistor being provided in a fourteenth electrically-conductive path between a fifth power terminal and the third output terminal, the third input circuit including a fourteenth transistor and a fifteenth transistor, the fourteenth transistor being provided in a fifteenth electrically-conductive path between a third input terminal and a gate terminal of the twelfth transistor, the fifteenth transistor being provided in a sixteenth electrically-conductive path between an eighth control terminal and a gate terminal of the fourteenth transistor, the eighth control terminal being coupled to the third control signal line, and the third reset circuit including a sixteenth transistor and an eighteenth electrically-conductive path, the sixteenth transistor being provided in a seventeenth electrically-conductive path between a sixth power terminal and the gate terminal of the twelfth transistor, and the eighteenth electrically-conductive path coupling a ninth control terminal and a gate terminal of the sixteenth transistor to each other.

(11)

The driver circuit according to any one of (8) to (10), further including:

a power circuit that supplies a fixed voltage to each of the first power terminal and the second power terminal, the fixed voltage supplied to the second power terminal being lower than the fixed voltage supplied to the first power terminal; and a control circuit that supplies a clock signal to each of the second control terminal and the third control terminal, the clock signal having a low level corresponding to a voltage that is lower than the fixed voltage supplied to the first power terminal.

(12)

The driver circuit according to (11), wherein the first input terminal is coupled to the first output terminal of one preceding register circuit included in the plurality of register circuits, and the control circuit supplies, to the second control terminal, the clock signal having the same phase as a signal supplied to the first input terminal.

(13)

A display unit, including:

a pixel array section including a plurality of pixels that are arranged in a matrix; and a driver circuit that drives the pixels, the driver circuit including a scanning circuit that scans the pixels on a predetermined unit basis, and a control circuit that controls the scanning circuit, the scanning circuit including a shift register circuit including a plurality of register circuits that are coupled in series and include a plurality of register circuits as a sub-group, and a plurality of control signal lines that are coupled to the shift register circuit, the plurality of register circuits as the sub-group each including an output circuit and an input circuit, the output circuit including a first transistor and a second transistor, the first transistor being provided in a first electrically-conductive path between a first control terminal and a first output terminal, the first control terminal being coupled to a first control signal line included in the plurality of control signal lines, and the second transistor being provided in a second electrically-conductive path between a first power terminal and the first output terminal, and the input circuit including a third transistor and a fourth transistor, the third transistor being provided in a third electrically-conductive path between a first input terminal and a gate terminal of the first transistor, the fourth transistor being provided in a fourth electrically-conductive path between a second control terminal and a gate terminal of the third transistor and having a gate terminal that is coupled to the first input terminal, and the second control terminal being coupled to a second control signal line included in the plurality of control signal lines.

(14)

The display unit according to (13), further including a reset circuit including a fifth transistor and a sixth electrically-conductive path, the fifth transistor being provided in a fifth electrically-conductive path between a second power terminal and the gate terminal of the first transistor, the sixth electrically-conductive path coupling a third control terminal and a gate terminal of the fifth transistor to each other, and the third control terminal being coupled to a third control signal line included in the plurality of control signal lines.

(15)

The display unit according to (14), wherein the control circuit supplies three clock signals included in a three-phase clock signal to the respective first to third control signal lines.

(16)

A driver circuit, including:

a shift register circuit including a plurality of register circuits that are coupled in series; and a control circuit that supplies a clock signal to the shift register circuit, the plurality of register circuits, except for a first register circuit, each including an input transistor having a drain terminal that receives, as an input signal, an output signal from one preceding register circuit included in the plurality of register circuits, an output transistor that controls an output signal outputted from a source terminal of the output transistor, on a basis of one of a source voltage of the input transistor and a voltage correlated with the source voltage of the input transistor, a capacitor that holds a gate-source voltage of the output transistor, and an input stabilizer circuit that stabilizes a gate voltage of the input transistor when the input transistor is turned off, on a basis of the clock signal supplied from the control circuit.

(17)

The driver circuit according to (16), wherein the input stabilizer circuit includes a first control transistor provided in an electrically-conductive path between a control terminal and a gate terminal of the input transistor, and the control terminal receiving the clock signal.

(18)

The driver circuit according to (17), wherein the input stabilizer circuit further includes a second control transistor coupled to the input transistor in series and having a gate terminal that receives the output signal from the one preceding register circuit included in the plurality of register circuits.

(19)

The driver circuit according to any one of (16) to (18), wherein the plurality of register circuits, except for the first register circuit, each further include a gate stabilizer circuit that stabilizes a gate voltage of the output transistor when the input transistor is turned off, on a basis of the clock signal supplied from the control circuit.

(20)

The driver circuit according to any one of (16) to (19), wherein the plurality of register circuits, except for the first register circuit, each further include an output stabilizer circuit that stabilizes an output signal outputted from a source terminal of the output transistor when the input transistor is turned off, on a basis of the clock signal supplied from the control circuit.

(21) A display unit, including:

a pixel array section including a plurality of pixels that are arranged in a matrix; and a driver circuit that drives the respective plurality of pixels, the driver circuit including a scanning circuit that scans the respective plurality of pixels on a predetermined unit basis, and a control circuit that controls the scanning circuit, the scanning circuit including a shift register circuit including a plurality of register circuits that are coupled in series, and a control circuit that supplies a clock signal to the shift register circuit, the plurality of register circuits, except for a first register circuit, each including an input transistor having a drain terminal that receives, as an input signal, an output signal from one preceding register circuit included in the plurality of register circuits, an output transistor that controls an output signal outputted from a source terminal of the output transistor, on a basis of one of a source voltage of the input transistor and a voltage correlated with the source voltage of the input transistor, a capacitor that holds a gate-source voltage of the output transistor, and an input stabilizer circuit that stabilizes a gate voltage of the input transistor when the input transistor is turned off, on a basis of the clock signal supplied from the control circuit.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A register circuit, comprising:

an output circuit including a first control terminal, a first power terminal, an output terminal, a first electrically-conductive path between the first control terminal and the output terminal, a second electrically-conductive path between the first power terminal and the output terminal, a first transistor provided in the first electrically-conductive path, the first transistor having a first terminal directly connected to the first control terminal and a second terminal directly connected to the output terminal, and a second transistor provided in the second electrically-conductive path, the second transistor having a first terminal directly connected to the first power terminal and a second terminal directly connected to the output terminal;

an input circuit including an input terminal, a second control terminal, a third electrically-conductive path between the input terminal and a gate terminal of the first transistor, a third transistor provided in the third electrically-conductive path, the third transistor having a first terminal directly connected to the input terminal, a fourth electrically-conductive path between the second control terminal and a gate terminal of the third transistor, and a fourth transistor provided in the fourth electrically-conductive path, the fourth transistor having a first terminal directly connected to the second control terminal, a second terminal directly connected to the gate terminal of the third transistor, and a gate terminal that is directly connected to the input terminal; and a reset circuit including a second power terminal, a fifth electrically-conductive path between the second power terminal and the gate terminal of the first transistor, and a fifth transistor provided in the fifth electrically-conductive path, the fifth transistor having a first terminal directly connected to the gate terminal of the first transistor and a second terminal directly connected to the second power terminal.

2. The register circuit according to claim 1, wherein each of the first transistor, the second transistor, the third transistor, the fourth transistor, and the fifth transistor is an n-channel metal-oxide-semiconductor thin film transistor.

3. The register circuit according to claim 1, wherein the input circuit further includes a sixth transistor coupled to the third transistor in series in the third electrically-conductive path and coupled to the fifth transistor in series, the sixth transistor having a gate terminal that is coupled to the input terminal.

4. The register circuit according to claim 1, wherein the output circuit further includes a capacitor that holds a potential difference between the gate terminal of the first transistor and the output terminal.

5. The register circuit according to claim 1, wherein the second transistor has a gate terminal that is coupled to a gate terminal of the fifth transistor, and the output circuit further includes a transistor that is coupled to the second transistor in parallel and has a gate terminal that is coupled to the second control terminal.

6. A driver circuit, comprising:

a shift register circuit including a plurality of register circuits that are coupled in series and include a plurality of first register circuits;

a plurality of control signal lines that are coupled to the shift register circuit, the plurality of first register circuits each including a first output circuit and a first input circuit, the first output circuit including a first control terminal coupled to a first control signal line included in the plurality of control signal lines, a first power terminal, a first output terminal, a first electrically-conductive path between the first control terminal and the first output terminal, a second electrically-conductive path between the first power terminal and the first output terminal, a first transistor provided in the first electrically-conductive path, the first transistor having a first terminal directly connected to the first control terminal and a second terminal directly connected to the first output terminal, and a second transistor provided in the second electrically-conductive path, the second transistor having a first terminal directly connected to the first power terminal and a second terminal directly connected to the first output terminal, and the first input circuit including a first input terminal, a second control terminal coupled to a second control signal line included in the plurality of control signal lines, a third electrically-conductive path between the first input terminal and a gate terminal of the first transistor, a third transistor provided in the third electrically-conductive path, the third transistor having a first terminal directly connected to the first input terminal, a fourth electrically-conductive path between the second control terminal and a gate terminal of the third transistor, and a fourth transistor provided in the fourth electrically-conductive path, the fourth transistor having a first terminal directly connected to the second control terminal, a second terminal directly connected to the gate terminal of the third transistor, and a gate terminal that is directly connected to the first input terminal; and a first reset circuit including a second power terminal, a third control terminal coupled to a third control signal line included in the plurality of control signal lines, a fifth electrically-conductive path between the second power terminal and the gate terminal of the first transistor, a fifth transistor provided in the fifth electrically-conductive path, the fifth transistor having a first terminal directly connected to the gate terminal of the first transistor and a second terminal directly connected to the second power terminal, and a sixth electrically-conductive path that directly connects the third control terminal and a gate terminal of the fifth transistor to each other.

7. The driver circuit according to claim 6, wherein the plurality of control signal lines further include a fourth control signal line, a fifth control signal line, and a sixth control signal line in addition to the first control signal line, the second control signal line, and the third control signal line, the plurality of register circuits include a plurality of second register circuits and a plurality of third register circuits in addition to the plurality of first register circuits, the plurality of second register circuits each being coupled to the second control signal line, the fourth control signal line, and the fifth control signal line, and the plurality of third register circuits each being coupled to the third control signal line, the fifth control signal line, and the sixth control signal line.

8. The driver circuit according to claim 7, wherein the plurality of second register circuits each include a second output circuit, a second input circuit, and a second reset circuit, and the plurality of third register circuits each include a third output circuit, a third input circuit, and a third reset circuit, the second output circuit including a seventh transistor and an eighth transistor, the seventh transistor being provided in a seventh electrically-conductive path between a fourth control terminal and a second output terminal, the fourth control terminal being coupled to the fourth control signal line, the eighth transistor being provided in an eighth electrically-conductive path between a third power terminal and the second output terminal, the second input circuit including a ninth transistor and a tenth transistor, the ninth transistor being provided in a ninth electrically-conductive path between a second input terminal and a gate terminal of the seventh transistor, the tenth transistor being provided in a tenth electrically-conductive path between a fifth control terminal and a gate terminal of the ninth transistor, the fifth control terminal being coupled to the fifth control signal line, the second reset circuit including an eleventh transistor and a twelfth electrically-conductive path, the eleventh transistor being provided in an eleventh electrically-conductive path between a fourth power terminal and the gate terminal of the seventh transistor, the twelfth electrically-conductive path coupling a sixth control terminal and a gate terminal of the eleventh transistor to each other, the third output circuit including a twelfth transistor and a thirteenth transistor, the twelfth transistor being provided in a thirteenth electrically-conductive path between a seventh control terminal and a third output terminal, the seventh control terminal being coupled to the sixth control signal line, the thirteenth transistor being provided in a fourteenth electrically-conductive path between a fifth power terminal and the third output terminal, the third input circuit including a fourteenth transistor and a fifteenth transistor, the fourteenth transistor being provided in a fifteenth electrically-conductive path between a third input terminal and a gate terminal of the twelfth transistor, the fifteenth transistor being provided in a sixteenth electrically-conductive path between an eighth control terminal and a gate terminal of the fourteenth transistor, the eighth control terminal being coupled to the third control signal line, and the third reset circuit including a sixteenth transistor and an eighteenth electrically-conductive path, the sixteenth transistor being provided in a seventeenth electrically-conductive path between a sixth power terminal and the gate terminal of the twelfth transistor, and the eighteenth electrically-conductive path coupling a ninth control terminal and a gate terminal of the sixteenth transistor to each other.

9. The driver circuit according to claim 6, further comprising:

a power circuit that supplies a fixed voltage to each of the first power terminal and the second power terminal, the fixed voltage supplied to the second power terminal being lower than the fixed voltage supplied to the first power terminal; and a control circuit that supplies a clock signal to each of the second control terminal and the third control terminal, the clock signal having a low level corresponding to a voltage that is lower than the fixed voltage supplied to the first power terminal.

10. The driver circuit according to claim 9, wherein the first input terminal is coupled to the first output terminal of one preceding register circuit included in the plurality of register circuits, and the control circuit supplies, to the second control terminal, the clock signal having the same phase as a signal supplied to the first input terminal.

11. A display unit, comprising:

a pixel array section including a plurality of pixels that are arranged in a matrix;

a driver circuit that drives the plurality of pixels, the driver circuit including a scanning circuit that scans the plurality of pixels on a predetermined unit basis, and a control circuit that controls the scanning circuit, the scanning circuit including a shift register circuit including a plurality of register circuits that are coupled in series and include a second plurality of register circuits as a sub-group, and a plurality of control signal lines that are coupled to the shift register circuit, the second plurality of register circuits each including an output circuit and an input circuit, the output circuit including a first control terminal coupled to a first control signal line included in the plurality of control signal lines, a first power terminal, an output terminal, a first electrically-conductive path between the first control terminal and the output terminal, a second electrically-conductive path between the first power terminal and the output terminal, a first transistor provided in the first electrically-conductive path, the first transistor having a first terminal directly connected to the first control terminal and a second terminal directly connected to the output terminal, and a second transistor provided in the second electrically-conductive path, the second transistor having a first terminal directly connected to the first power terminal and a second terminal directly connected to the output terminal, and the input circuit including an input terminal, a second control terminal coupled to a second control signal line included in the plurality of control signal lines, a third electrically-conductive path between the input terminal and a gate terminal of the first transistor, a third transistor provided in the third electrically-conductive path, the third transistor having a first terminal directly connected to the input terminal, a fourth electrically-conductive path between the second control terminal and a gate terminal of the third transistor, and a fourth transistor provided in the fourth electrically-conductive path, the fourth transistor having a first terminal directly connected to the second control terminal, a second terminal directly connected to the gate terminal of the third transistor, and a gate terminal that is directly connected to the input terminal; and a reset circuit including a second power terminal, a third control terminal coupled to a third control signal line included in the plurality of control signal lines, a fifth electrically-conductive path between the second power terminal and the gate terminal of the first transistor, a fifth transistor provided in the fifth electrically-conductive path, the fifth transistor having a first terminal directly connected to the gate terminal of the first transistor and a second terminal directly connected to the second power terminal, and a sixth electrically-conductive path that directly connects the third control terminal and a gate terminal of the fifth transistor to each other.

12. The display unit according to claim 11, wherein the control circuit supplies three clock signals included in a three-phase clock signal to the respective first to third control signal lines.

* * * * *